US009907362B2

(12) United States Patent
Hatfield et al.

(10) Patent No.: US 9,907,362 B2
(45) Date of Patent: Mar. 6, 2018

(54) ARTICLES OF FOOTWEAR

(71) Applicant: NIKE, Inc., Beaverton, OR (US)

(72) Inventors: Tobie D. Hatfield, Lake Oswego, OR (US); Thomas Berend, Beaverton, OR (US); Kevin J. Rucier, Beaverton, OR (US); Patricia L. Smaldone, Portland, OR (US); Chun-Chuan Lai, Changhua County (TW)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/050,748

(22) Filed: Feb. 23, 2016

(65) Prior Publication Data

US 2016/0166009 A1 Jun. 16, 2016

Related U.S. Application Data

(63) Continuation of application No. 13/693,311, filed on Dec. 4, 2012, now Pat. No. 9,295,304.

(Continued)

(51) Int. Cl.

| | |
|---|---|
| ***A43C 11/00*** | (2006.01) |
| ***A43B 23/02*** | (2006.01) |
| ***A43B 13/26*** | (2006.01) |
| ***A43C 11/14*** | (2006.01) |
| ***A43B 7/20*** | (2006.01) |

(Continued)

(52) U.S. Cl.

CPC ..... *A43C 11/008* (2013.01); *A43B 7/20* (2013.01); *A43B 13/14* (2013.01); *A43B 13/141* (2013.01); *A43B 13/223* (2013.01); *A43B 13/26* (2013.01); *A43B 23/02* (2013.01); *A43B 23/0265* (2013.01); *A43B 23/07* (2013.01); *A43C 1/04* (2013.01); *A43C 11/1493* (2013.01); *A43C 15/162* (2013.01)

(58) Field of Classification Search

CPC ..... A43C 1/04; A43C 11/008; A43C 11/1493
USPC ..... 36/105, 50.1, 51; D2/973, 972, 969
See application file for complete search history.

(56) References Cited

U.S. PATENT DOCUMENTS 3,859,739 A * 1/1975 Dassler ..... A43C 15/162 36/67 D
4,282,657 A 8/1981 Antonious (Continued)

OTHER PUBLICATIONS

Non-Final Office Action dated Aug. 21, 2015 in U.S. Appl. No. 13/693,311.

(Continued)

*Primary Examiner* — Ted Kavanaugh
(74) *Attorney, Agent, or Firm* — Banner & Witcoff, Ltd.

(57) ABSTRACT

Articles of footwear, including athletic footwear, include: (A) an upper; (B) a rear heel strap member engaged with or integrally formed with the upper and including: (i) a rear heel element, (ii) a lateral side strap element, and (iii) a medial side strap element; (C) a first strap member extending along the medial side of the upper, wherein the first strap member includes at least one structure for engaging a lace; (D) a second strap member extending along the lateral side of the upper, wherein the second strap member includes at least two structures for engaging the lace; (E) a tensioning system for engaging the medial side strap element with the first strap member; (F) another tensioning system for engaging the lateral side strap element with the second strap member; and (G) a sole structure.

20 Claims, 17 Drawing Sheets

Related U.S. Application Data

(60) Provisional application No. 61/578,515, filed on Dec. 21, 2011.

(51) Int. Cl.

| | |
|---|---|
| ***A43C 15/16*** | (2006.01) |
| ***A43B 13/22*** | (2006.01) |
| ***A43B 13/14*** | (2006.01) |
| ***A43B 23/07*** | (2006.01) |
| ***A43C 1/04*** | (2006.01) |

(56) References Cited

U.S. PATENT DOCUMENTS

| | | | | | |
|---|---|---|---|---|---|
| D342,604 | S | * | 12/1993 | Avar | D2/970 |
| D343,724 | S | * | 2/1994 | Smith | D2/969 |
| D365,923 | S | | 1/1996 | Crowley | |
| 5,497,564 | A | * | 3/1996 | Allen | A43C 5/00 24/713.7 |
| 5,533,279 | A | * | 7/1996 | Mitsui | A43B 5/00 36/45 |
| 6,128,835 | A | * | 10/2000 | Ritter | A43C 1/00 36/114 |
| 6,467,193 | B1 | * | 10/2002 | Okajima | A43B 5/0405 36/10 |
| D468,079 | S | * | 1/2003 | DeGrand | D2/947 |
| 6,772,541 | B1 | * | 8/2004 | Ritter | A43B 7/14 36/50.1 |
| D509,950 | S | * | 9/2005 | Adams | D2/954 |
| D568,597 | S | * | 5/2008 | Alfaro | D2/972 |
| 8,302,329 | B2 | * | 11/2012 | Hurd | A43B 7/20 36/68 |
| 2010/0199523 | A1 | | 8/2010 | Mayden et al. | |
| 2011/0113650 | A1 | * | 5/2011 | Hurd | A43B 23/08 36/107 |
| 2011/0214313 | A1 | | 9/2011 | James et al. | |

OTHER PUBLICATIONS

Nov. 24, 2015—(U.S.) Notice of Allowance—U.S. Appl. No. 13/693,311.

* cited by examiner

ARTICLES OF FOOTWEAR

RELATED APPLICATION DATA

This application is a continuation of co-pending U.S. patent application Ser. No. 13/693,311 filed Dec. 4, 2012, which application is a non-provisional of U.S. Provisional Patent Appln. No. 61/578,515, filed Dec. 21, 2011. Each of these priority applications is entirely incorporated herein by reference.

FIELD OF THE INVENTION

The present invention relates to the field of footwear. More specifically, aspects of the present invention pertain to articles of athletic footwear that include cleat structures, strapping systems, and/or improved natural motion characteristics, as well as to methods of making such articles of footwear.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure may provide traction and control potentially harmful foot motion, such as over pronation. The general features and configuration of the upper and the sole structure are discussed in greater detail below.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

Various materials may be utilized in manufacturing the upper. The upper of an article of athletic footwear, for example, may be formed from multiple material layers that may include, for example, an exterior layer, a middle layer, and an interior layer (and these layers may fully or partially overlap). The materials forming the exterior layer (or other layers) of the upper may be selected based upon the properties of wear-resistance, abrasion resistance, durability, flexibility, stretchability, and air-permeability, for example. With regard to the exterior layer, the toe area and the heel area may be formed of leather, synthetic leather, or a rubber material to impart a relatively high degree of wear-resistance and abrasion resistance. Leather, synthetic leather, and rubber materials, however, may not exhibit the desired degree of flexibility and/or air-permeability for all areas of the upper. Accordingly, various other areas of the exterior layer of the upper may be formed from a synthetic textile. The exterior layer of the upper may be formed, therefore, from numerous material elements that each imparts different properties to specific areas of the upper.

A middle (or other) layer of the upper may be formed from a lightweight polymer foam material that improves overall comfort and protects the foot from objects that may contact the upper. Similarly, an interior layer of the upper may be formed of a moisture-wicking textile that removes perspiration from the area immediately surrounding the foot. In some articles of athletic footwear, the various layers may be joined with an adhesive, and stitching may be utilized to join elements within a single layer or to reinforce specific areas of the upper.

The sole structure generally incorporates multiple layers that are conventionally referred to as an insole, a midsole, and an outsole. The insole (which also may constitute a sock liner) is a thin member located within the upper and adjacent the plantar (lower) surface of the foot to enhance footwear comfort, e.g., to wick away moisture and provide a soft, comfortable feel. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

Despite the various available footwear models and characteristics, new footwear models and constructions continue to develop and are a welcome advance in the art.

SUMMARY OF THE INVENTION

This Summary is provided to introduce some general concepts relating to this invention in a simplified form that are further described below in the Detailed Description. This Summary is not intended to identify key features or essential features of the invention.

While useful for any desired types or styles of shoes, aspects of this invention may be of particular interest for articles of athletic footwear that include cleat structures, strapping systems, sole structures, and/or improved natural motion characteristics. Still additional aspects of this invention relate to methods for making articles of footwear and particularly sole structures for articles of footwear. More specific aspects of this invention will be described in more detail below.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and methods without departing from the scope of the present invention.

I. General Description of Aspects of this Invention

Aspects of this invention relate to articles of footwear (e.g., athletic footwear) that include cleat structures, strapping systems, and/or improved natural motion characteristics. More specific features and aspects of this invention will be described in more detail below.

As used in this specification, "longitudinal" generally means extending in a front-to-rear (or heel-to-toe) direction of an article of footwear or component thereof, and "longitudinal" elements or components may be straight or curved. "Transverse" generally means extending in a side-to-side (or medial side-to-lateral side) direction of an article of footwear or component thereof, and "transverse" elements or components may be straight or curved.

Figure 1A:
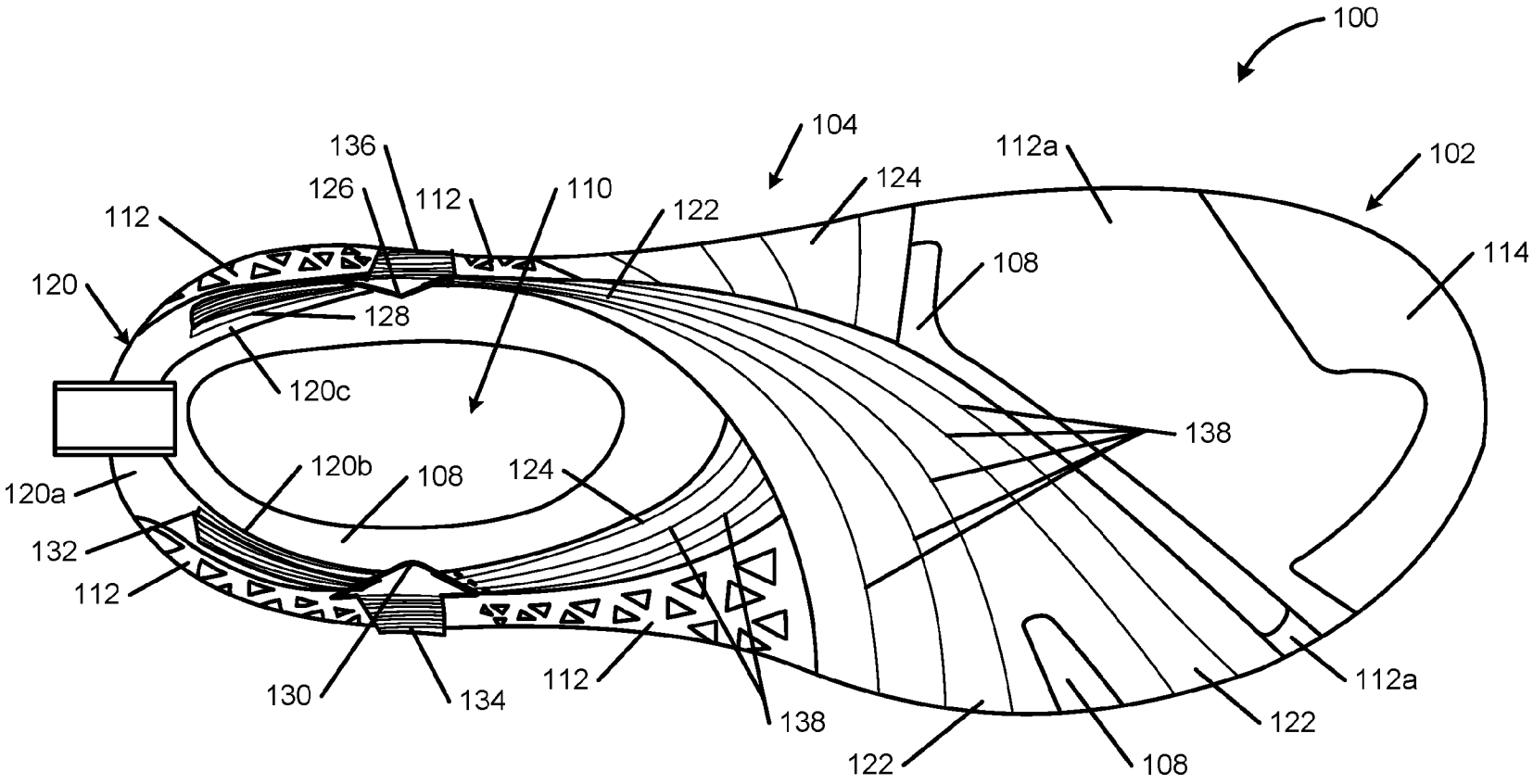
FIGS. 1A through 1D illustrate various views of an example article of footwear including various features and aspects of this invention.
Figure 1B:
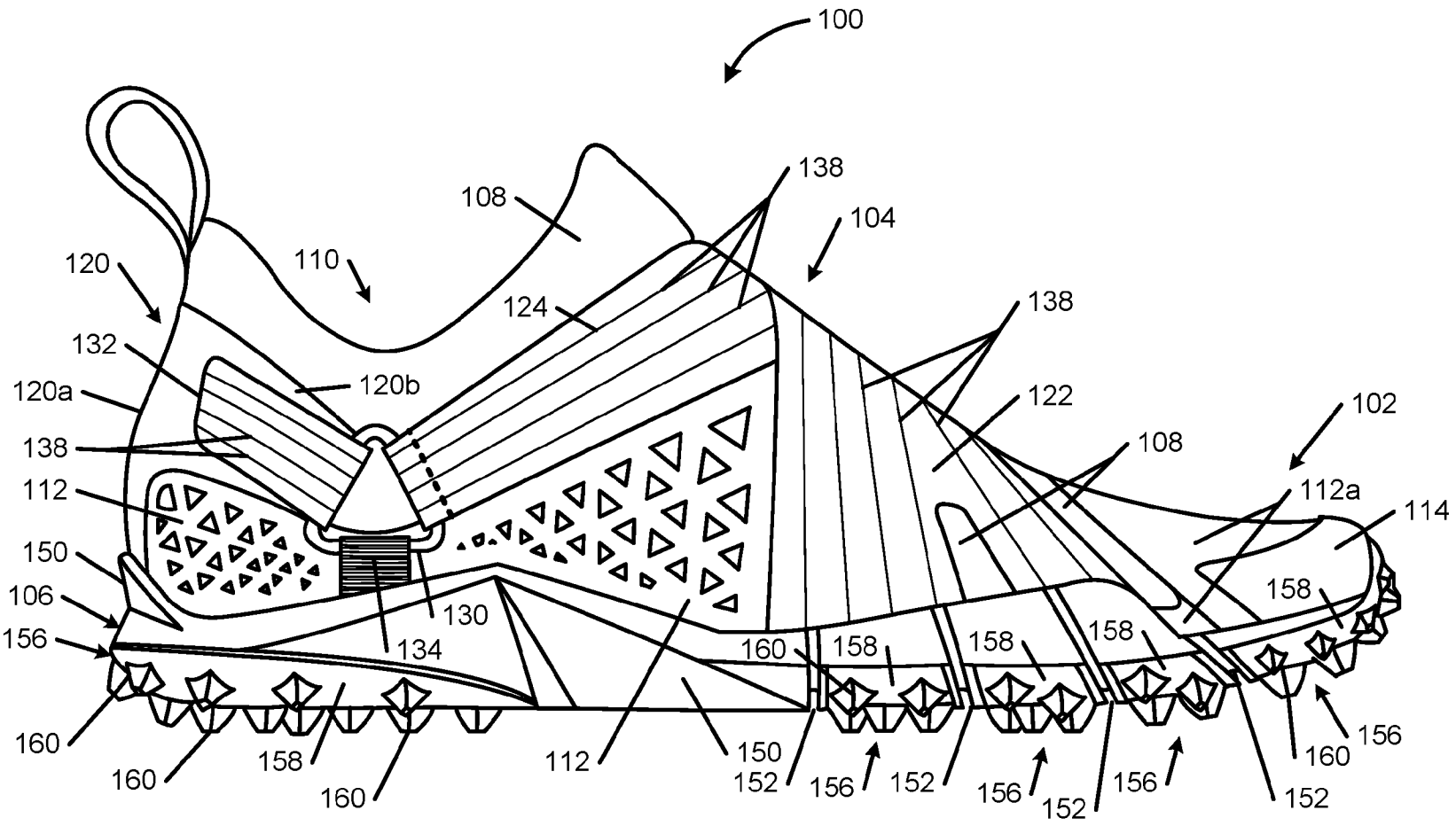
Figure 1C:
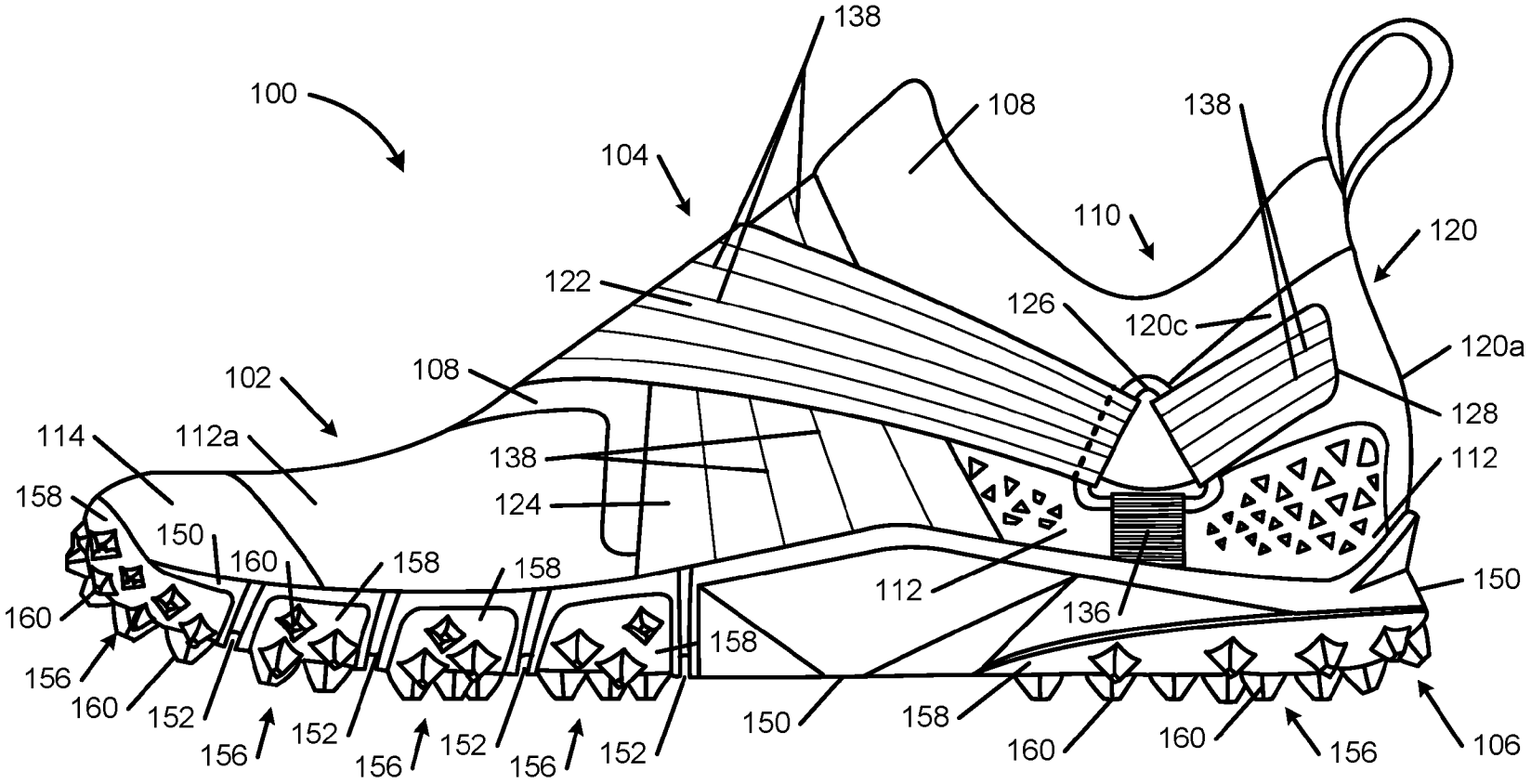
Figure 1D:
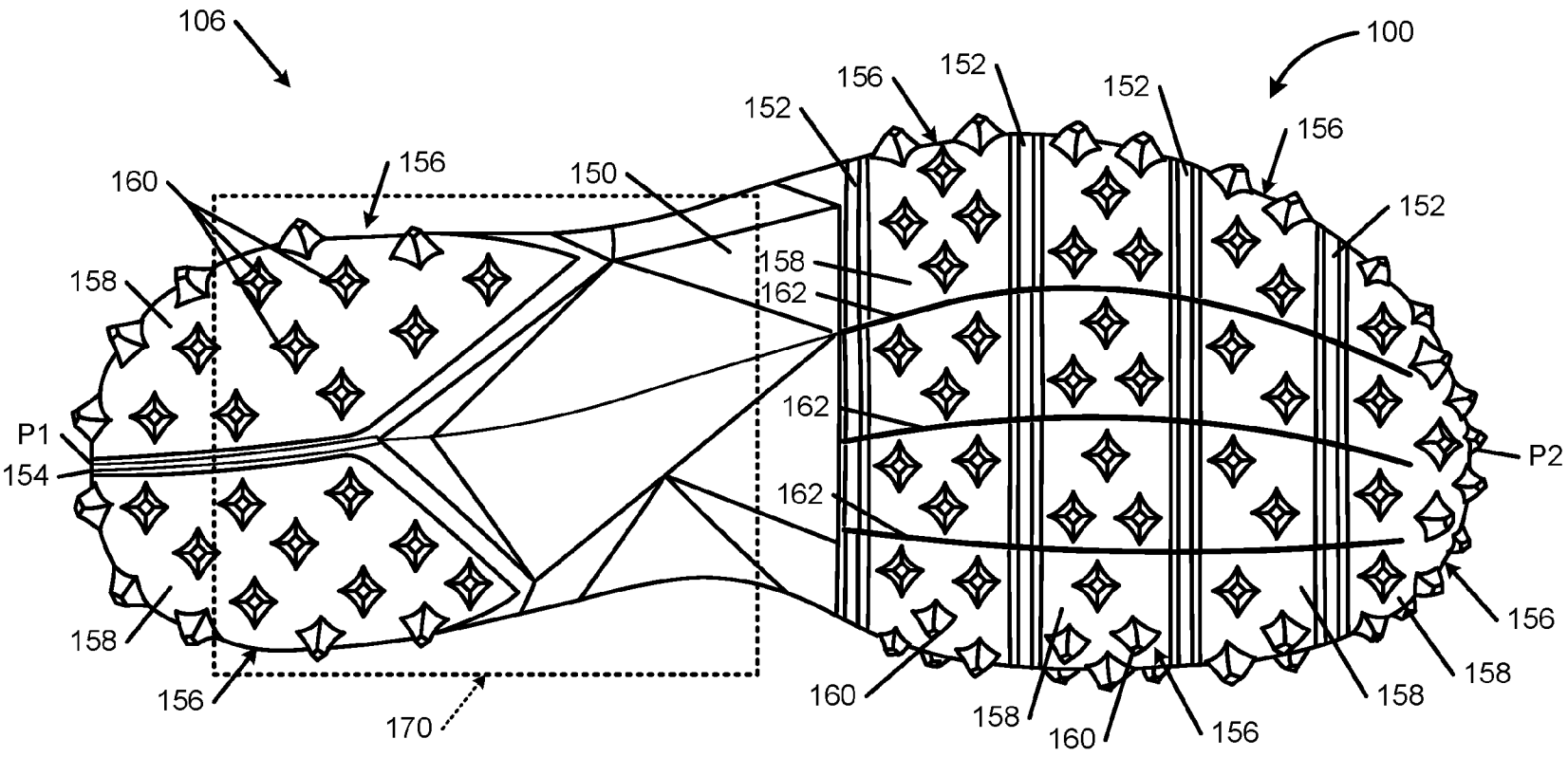

The "longitudinal direction," as used in this specification, is determined by a line connecting a rearmost heel (or other) point of an item (e.g., see point P1 of the sole structure of FIG. 1D) and the forward most toe (or other) point of the item (e.g., see point P2 of the sole structure of FIG. 1D). If the forward most and/or rearmost locations of a specific item constitute line segments, then the forward most point and/or the rearmost point constitute the mid-point of the corresponding line segment. If the forward most and/or rearmost locations of a specific item constitute two or more separated points or line segments, then the forward most point and/or the rearmost point constitute the mid-point of a line segment spanning and connecting the separated points or line segments. The "transverse direction" is orthogonal to the longitudinal direction.

A. Cleat Features

Some aspects of this invention relate to cleats that may be included in or on sole structures and articles of footwear. Such cleats may be useful, e.g., in athletic footwear for football, soccer, baseball, softball, or the like, and such cleats may be designed for use on natural grass, synthetic turf, or other contact surfaces.

As some more specific examples, cleats for articles of footwear in accordance with at least some examples of this invention may include: (a) a cleat base, wherein an outer perimeter of the cleat base constitutes a closed geometric shape having from three to five inwardly curved sides and three to five corner regions joining adjacent sides (four sides and corner regions in some example cleat structures); (b) a cleat end surface, wherein an outer perimeter of the cleat end surface constitutes a closed geometric shape having from three to five inwardly curved sides and three to five corner regions joining adjacent sides, wherein the closed geometric shape of the cleat base has the same number of sides and corner regions as the closed geometric shape of the cleat end surface, and wherein the closed geometric shape of the cleat end surface encloses a smaller area than the closed geometric shape of the cleat base; and (c) a cleat body extending between the cleat base and the cleat end surface, wherein the cleat body includes a plurality of edges, wherein each edge of the plurality of edges extends between a corner region of the cleat base and a corresponding corner region of the cleat end surface.

If desired, the edges of the cleat body may be curved, optionally curved inward (toward an interior of the overall cleat structure). The cleat body further may include side walls extending between adjacent edges of the cleat body, and these side walls likewise may be curved (optionally inwardly curved).

B. Upper/Strapping System Features

Some aspects of this invention relate to uppers and/or strapping systems included as part of or on uppers for articles of footwear. One aspect of this invention relates to upper members and/or strapping systems that need not include conventional shoe laces for securing the upper to the wearer's foot. Such uppers/strapping systems may include one or more of: (a) an upper member (optionally including a bootie element) defining a medial side, a lateral side, a rear heel area, and an ankle opening; (b) a rear heel strap member engaged with or integrally formed with the rear heel area of the upper member, wherein the rear heel strap member includes: (i) a rear heel element, (ii) a lateral side strap element that extends from the rear heel element and along the lateral side of the ankle opening and the upper member, and (iii) a medial side strap element that extends from the rear heel element and along the medial side of the ankle opening and the upper member; (c) a first strap member extending from the medial side of the ankle opening, across a front of the ankle opening, to at least one of a lateral midfoot or lateral forefoot area of the upper member; (d) a second strap member extending from the lateral side of the ankle opening, across the front of the ankle opening, to a medial midfoot area of the upper member; (e) a first tensioning system for engaging the medial side strap element with the first strap member; (f) a second tensioning system for engaging the lateral side strap element with the second strap member; (g) a medial heel strap extending from the first tensioning system toward a plantar support surface at a central, medial heel location of the upper member; and/or (h)

a lateral heel strap extending from the second tensioning system toward the plantar support surface at a central, lateral heel location of the upper member. While such uppers and/or strapping systems need not be used with conventional shoe laces or other shoe securing systems, these uppers and/or strapping systems could be used along with laces or other shoe securing systems, if desired.

The lateral heel strap and the medial heel strap may constitute opposite ends of a single strap member that extends beneath and across the plantar support surface, or they may be separate parts (e.g., that terminate beneath the plantar support surface of the article of footwear, optionally between sole components or between the upper and a sole component). Similarly, the first strap member and the second strap member may constitute opposite ends of a single strap element that extends beneath and across a plantar support surface of the article of footwear, or they may be separate parts (e.g., that terminate beneath the plantar support surface of the article of footwear, optionally between sole components or between the upper and a sole component). The first strap member (i.e., the one that extends to at least one of a lateral midfoot or lateral forefoot area of the upper) may be split into separate straps or bands at a location proximate to the lateral midfoot or lateral forefoot area, if desired.

Other aspects of this invention relate to upper members and/or strapping systems that include conventional shoe laces to help secure the upper to the wearer's foot. Such uppers/strapping systems may include one or more of: (a) an upper member (optionally including a bootie element) defining a medial side, a lateral side, a rear heel area, and an ankle opening; (b) a rear heel strap member engaged with or integrally formed with the rear heel area of the upper member, wherein the rear heel strap member includes: (i) a rear heel element, (ii) a lateral side strap element that extends from the rear heel element and along the lateral side of the ankle opening and the upper member, and (iii) a medial side strap element that extends from the rear heel element and along the medial side of the ankle opening and the upper member; (c) a first strap member extending along the medial side of the upper member and to a medial midfoot area of the upper member, wherein the first strap member includes at least one structure for engaging a lace; (d) a second strap member extending along the lateral side of the upper member, along a lateral midfoot area of the upper member, and to a lateral forefoot area of the upper member, wherein the second strap member includes at least two structures for engaging the lace; (e) a first tensioning system for engaging the medial side strap element with the first strap member; (f) a second tensioning system for engaging the lateral side strap element with the second strap member; and/or (g) a lace engaged with the upper member, engaged with the structure or structures for engaging the lace provided with the first strap member, and engaged with the structures for engaging the lace provided with the second strap member.

If desired, the two (or more) structures for engaging the lace provided with the second strap member (and optionally all of these structures) may be located closer to a forward-most location of the article of footwear than the structure(s) for engaging the lace provided with the first strap member. The upper member or other portions of the article of footwear further may include structures for engaging the lace that are not included as part of the first strap member or the second strap member.

C. Sole Structure Features

Additional aspects of this invention relate to sole structures for articles of footwear. In one example, sole structures according to this aspect of the invention may include: (a) a base member; and (b) a plurality of cleats engaged with or integrally formed with the base member. At least some of the cleats in such structures may have the cleat structures or configurations described above. While the sole structure may have plural cleats of the types described above, not all of these cleats have to be of the same size and/or have the same curvatures or specifications.

Such sole structures may have additional features as well. For example, the sole structures described in the preceding paragraph further may include a midsole member engaged with the base member. The midsole member may be made from rubber (natural or synthetic) and/or a polymer material, such as polyurethane foam materials, thermoplastic polyurethane materials, ethylvinylacetate foam materials, phylon, phylite, injection phylon, etc. The midsole member may be sized and shaped so as to support an entire plantar surface of a wearer's foot.

Sole structures for articles of footwear in accordance with another aspect of this invention may include: (a) a midsole member including at least: a first transverse groove in a midfoot or forefoot area and a second transverse groove located forward of the first transverse groove; (b) a first cleat bearing member engaged with the midsole member and located rearward of the first transverse groove; and (c) a second cleat bearing member engaged with the midsole member located between the first transverse groove and the second transverse groove. The cleat bearing members do not extend into the transverse grooves and are completely separated from one another by the transverse grooves. Such articles of footwear further may include a third transverse groove in the midsole member located forward of the second transverse groove and a third cleat bearing member engaged with the midsole member located between the second and third transverse grooves. Additional grooves and/or cleat bearing members also may be provided in such sole structures.

The base members and/or other cleat bearing members of the sole structures described above may include additional features to enhance or improve the natural motion feel and capabilities of the sole structure. For example, the transverse grooves described above (grooves that generally extend in the medial-to-lateral direction of an article of footwear) may be deep enough and/or located at appropriate positions so as to enhance the natural motion properties of the sole structure. As potential features, the base members and/or other cleat bearing members according to at least some examples of this invention may include longitudinal sipes (e.g., cuts or grooves) that extend generally in the longitudinal direction of the sole structure. As some more specific examples, in the structure described above, the first cleat bearing member and the second cleat bearing member may have one or more continuous longitudinal sipes cut through them that extend generally in a longitudinal direction of the sole structure and optionally into a material of the midsole member underlying the cleat bearing members.

As another example, sole structures for articles of footwear according to at least some examples of this invention may include: (a) a heel area surface member having: (i) a lateral forward edge extending at an oblique angle from a longitudinal direction of the sole structure (and/or the heel area surface member), wherein the lateral forward edge extends from a central heel area of the heel area surface member to a location proximate a lateral side of the heel area surface member and (ii) a medial forward edge extending at an oblique angle from the longitudinal direction, wherein the medial forward edge extends from the central heel area of the heel area surface member to a location proximate a medial side of the heel area surface member; (b) an arch area surface member having: (i) a lateral rearward edge extending at an acute angle from the longitudinal direction, wherein the lateral rearward edge extends from a central rear location of the arch area surface member to a location proximate a lateral side of arch area surface member and (ii) a medial rearward edge extending at an acute angle from the longitudinal direction, wherein the medial rearward edge extends from the central rear location of the arch area surface member to a location proximate a medial side of arch area surface member; (c) a first side wall extending between the lateral forward edge of the heel area surface member and the lateral rearward edge of the arch area surface member, wherein the first side wall is angled in a forward/top-to-rear/bottom direction; and (d) a second side wall extending between the medial forward edge of the heel area surface member and the medial rearward edge of the arch area surface member, wherein the second side wall is angled in the forward/top-to-rear/bottom direction. The heel area surface member, the arch area surface member, the first side wall, and the second side wall may be made (e.g., molded) as a unitary, one piece construction or they may be formed from multiple parts (that are optionally engaged together). These components may be made from any desired materials without departing from this invention, including conventional midsole materials, such as a polyurethane foam material, a thermoplastic polyurethane material, an ethylvinylacetate foam material, phylon, injection phylon, phylite, etc.

Due to the side walls, the front of the heel area of the article of footwear forms a forward facing wall or walls (e.g., V-shaped or U-shaped) that can help provide traction to the wearer, particularly when moving rearward (e.g., backpedalling, etc.). To help provide the forward facing wall or walls, the height dimensions of either or both of the first and second side walls may taper from a greatest height at or near their interior-most locations to a smallest height or zero height at their end locations. In this manner, either or both of the side walls may have a generally triangular shaped exposed surface. The forward edges, rearward edges, and side walls may be straight or curved, and they may be oriented at an acute angle with respect to one another. Also, the interior-most location(s) of the forward edges (or the rearward edges) may be joined together directly or indirectly (e.g., by an intermediate wall).

Additionally, if desired, sole structures of this type may include a first cleat bearing member (e.g., of the types described above) engaged with the heel area surface member on a lateral side of a longitudinal central axis of the heel area surface member and a second cleat bearing member (e.g., of the types described above) engaged with the heel area surface member on a medial side of the longitudinal central axis. These cleat bearing members may be separated from one another by an exposed portion of the heel area surface member, and optionally, this exposed portion of the heel area surface member may include a flex groove or sipe formed in it (molded into it, cut into it, etc.).

D. Footwear Features

Additional aspects of this invention relate to articles of footwear including one or more of: (a) the cleats, (b) uppers, (c) strapping systems, (d) cleat bearing members, and/or (e) sole structures described above, and these components may be present individually or in any desired or possible combination in articles of footwear according to examples of this invention. The cleats, uppers, strapping systems, cleat bearing members, and/or sole structures may be combined or formed together in any desired manner, including through the use of cements or adhesives, mechanical connectors, fusing techniques, sewing or stitching, or the like.

E. Method Features

Additional aspects of this invention relate to methods of making articles of footwear or various components thereof. One more specific aspect of this invention relates to methods for making sole structures for articles of footwear that include one or more of: (a) forming a plurality of cleat bearing members including a base surface with a plurality of cleat elements extending from the base surface (e.g., by a molding step, in one or more molds); and (b) engaging a plurality of the cleat bearing members with a foamed polymer midsole element, optionally via a molding process (which may take place in the same mold as used to form the cleat bearing members or in a different mold). Alternatively, the cleat bearing members may be adhered to the midsole element via cements or adhesives. The cleat bearing members may be formed from any desired materials, including, for example, rubber (natural or synthetic) or thermoplastic polyurethane materials.

In methods according to this aspect of the invention, the shaping and molding of the foamed polymer material may include forming a plurality of flex grooves in the foamed polymer material, e.g., at a forefoot area, a midfoot area, and/or a heel area of the sole structure. These flex grooves can help provide the more natural "feel" or motion to the sole structure (e.g., more of a barefoot type "feel"). The cleat bearing members may be separated completely from one another by the flex grooves. As another example, if desired, the flex grooves may be formed into the cleat bearing member(s) and/or the foamed polymer material by a cutting action (e.g., laser cutting, hot knife cutting (pressing a hot blade or blades through the material(s)), mechanical cutting, localized melting, etc.).

Still additional aspects of this invention relate to sole structures and articles of footwear including sole structures made by the methods described above.

Given the general description of features, aspects, structures, processes, and arrangements according to the invention provided above, a more detailed description of specific example articles of footwear and methods in accordance with this invention follows.

II. Detailed Description of Example Articles of Footwear According to this Invention Referring to the figures and following discussion, various articles of footwear and features thereof in accordance with the present invention are disclosed. The footwear depicted and discussed are athletic shoes, and the concepts disclosed with respect to various aspects of this footwear may be applied to a wide range of athletic footwear styles, including, but not limited to: walking shoes, tennis shoes, soccer shoes, football shoes, basketball shoes, running shoes, and cross-training shoes. In addition, at least some concepts and aspects of the present invention may be applied to a wide range of non-athletic footwear, including work boots, sandals, loafers, and dress shoes. Accordingly, the present invention is not limited to the precise embodiments disclosed herein, but applies to footwear generally.

FIGS. 1A through 1D illustrate an example shoe or article of footwear 100 that includes some aspects of this invention. FIG. 1A constitutes an overhead view of the shoe 100, FIG. 1B constitutes a lateral side view, FIG. 1C constitutes a medial side view, and FIG. 1D constitutes a bottom view. The article of footwear 100 includes an upper 102, a strapping system 104 engaged or integrally formed with the upper 102 for securing the footwear 100 to a wearer's foot, and a sole structure 106. These components will be described in more detail below.

In this illustrated example, the upper 102 includes multiple parts that are joined together or otherwise structured in the footwear 100 in an appropriate manner, e.g., by sewing or stitching, by cements or adhesives, by mechanical connectors, by fusing techniques, or the like. One major component of this example upper 102 is the bootie element 108 that defines the ankle opening 110 and at least a portion of the interior chamber for receiving the wearer's foot. The bootie element 108 of this illustrated example forms the entire interior foot-receiving chamber of the shoe, although this is not a requirement. For example, if desired, the bootie element 108 need not include a bottom plantar support surface, and thus, it could attach to or fit over and/or around an insole, sockliner, strobel member, or other conventional plantar support surface structure. As another example, if desired, an insole, sockliner, or other conventional plantar support surface could be fit within the interior chamber of the bootie element 108. As yet another example, if desired, the bootie element 108 need not extend all the way to the perimeter of the shoe (e.g., not to the front toe and/or to the side edges). The bootie element 108 may be made from any desired materials without departing from this invention, including, for example, soft comfortable fabrics or textiles, including felts, cotton, tufted fabrics, neoprene, elastomeric fabrics, etc.

At least the heel and/or midfoot areas of the bootie element 108 in this example footwear structure 100 include an overlying shell 112. While the shell 112 may take on many different sizes, styles, shapes, and configurations without departing from this invention, in this illustrated example, the shell 112 is a relatively lightweight fabric, textile, or polymer material, such as nylon, that overlies the bootie element 108 (which may be exposed through the triangular openings in the illustrated shell 112). The shell 112 of this example provides improved durability and wear resistance by covering a large portion of the relatively soft bootie element 108 while still providing ample breathability and a lightweight construction. As another example, the shell 112 may be made from a stiffer, harder, or sturdier polymeric material, such as thermoplastic polyurethane, rubber, polyamide, or the like, to provide improved durability, wear resistance, and a more defined structure to the shoe.

The forefoot portion of the upper 102 also may include one or more shell components 112*a*, either as a separate component from or a continuous structure with shell 112. Shell component 112*a* of this example closes in the forefoot portion of the bootie element 108 and may provide any desired properties, such as abrasion or wear resistance, improved durability, defined structure, etc., and/or to protect the wearer's foot from external elements. The toe area of this example footwear 100 further includes a toe cap 114, to protect the toe area of the shoe from wear, abrasion, etc., and to protect the wearer's foot from external elements.

One noticeable feature of the example shoe 100 shown in FIGS. 1A through 1C is its lack of conventional shoe laces. Rather, this example shoe structure 100 includes a strapping system 104 including a series of straps for securing the shoe 100 to the wearer's foot. While the straps of the strapping system 104 may be integrally formed with one or more components of the upper 102, in this illustrated example, the strapping system 104 overlies portions of the upper, such as the bootie element 108 and at least portions of the shell 112. This example strapping system 104 will be described in more detail below.

A rear heel strap member 120 located in the rear heel area of the upper 102 constitutes one main component of the strapping system 104. This example rear heel strap member 120 includes: (a) a rear heel element 120*a*, (b) a lateral side strap element 120*b* that extends from the rear heel element 120*a* and along the lateral side of the upper 102 and the ankle opening 110, and (c) a medial side strap element 120*c* that extends from the rear heel element 120*a* and along the medial side of the upper 102 and the ankle opening 110. While shown as a single component in FIGS. 1A through 1C, the rear heel strap member 120 may be made from multiple parts, e.g., that are connected together in any desired manner, such as by sewing or stitching or by fusing techniques. The rear heel strap member 120 (and the various components thereof) may be attached to the upper 102, attached to some portion of the sole structure 106, and/or wrapped around a portion of the upper 102 and secured between the upper 102 and the sole structure 106. If desired, the rear heel strap member 120 may have somewhat of an overall "X" shape or configuration that wraps around the rear heel of the wearer (e.g., with the lateral side strap element 120*b* and the medial side strap element 120*c* forming the upper two arms of the "X" and two additional arms extending downward to meet the sole structure 106 (and extending between a plantar support surface and the midsole member 150)).

While it may be made from any desired materials, in the illustrated example, the rear heel strap member 120 may be made from a fabric or textile component, such as nylon, rayon, or polyester fabric or the like. In such examples, the heel area may be very lightweight and flexible, perhaps even collapsing under its own weight when not secured to a wearer's foot. In other examples, if desired, the rear heel strap member 120 (or at least some portion of the rear heel element 120*a* thereof) may be made from a harder, stiffer, or more durable material, e.g., to function more as a conventional heel counter (e.g., to protect the foot, to provide wear and abrasion resistance, to provide a more defined structure to the shoe, etc.).

The strapping system 104 includes additional foot securing components that, in this example, at least partially wrap around and secure the foot. As shown in FIGS. 1A through 1C, the strapping system 104 further includes a first strap member 122 extending from the medial side of the ankle opening 110, across a front of the ankle opening 110, to at least one of a lateral midfoot or lateral forefoot area of the upper 102. The first strap member 122 may at least partially wrap around the wearer's foot and be secured between the upper 102 and the sole structure 106 (e.g., beneath the plantar support surface). This example strapping system 104 further includes a second strap member 124 extending from the lateral side of the ankle opening 110, across the front of the ankle opening 110, to a medial midfoot area of the upper 102. Likewise, the second strap member 124 may at least partially wrap around the wearer's foot and be secured between the upper 102 and the sole structure 106 (e.g., beneath the plantar support surface). While the first strap member 122 and second strap member 124 may terminate beneath a plantar support surface of the article of footwear 100 (e.g., secured to the upper 102 or sole structure by stitching, adhesives, mechanical connectors, or the like), if desired, the first strap member 122 and the second strap member 124 may constitute opposite ends of a single strap component that extends completely beneath and across the plantar support surface of the article of footwear 100.

This example article of footwear 100 further includes structures for applying tension to the strapping system 104 to secure the footwear 100 on a wearer's foot. The medial side of the shoe 100 includes a first tensioning system for engaging the medial side strap element 120*c* with a free end of the first strap member 122. As shown in FIGS. 1A and 1C, this first tensioning system includes tensioning ring 126 and hook-and-loop fastener components 128 provided with the medial side strap element 120*c*. Similarly, as shown in FIGS. 1A and 1B, a second tensioning system is provided on the opposite side of the shoe and includes tensioning ring 130 and hook-and-loop fastener components 132 provided with the lateral side strap element 120*b*. In use, the strapping system 104 is tightened by feeding the free ends of side strap elements 120*c* and 120*b* through the tensioning rings 126 and 130, respectively, pulling the free ends of side strap elements 120*c* and 120*b* rearwardly, and then fixing the free ends of the side strap elements 120*c* and 120*b* in place using the hook-and-loop fastener components 128 and 132, respectively. The free ends of strap members 122 and 124 are secured to the tensioning rings 126 and 130, respectively, by stitching or sewing.

Other strap tensioning systems or arrangements may be made without departing from this invention. For example, if desired, the hook-and-loop fastening components 128 and 132 may be provided on first and second strap members 122 and 124 instead of (or in addition to) those provided on lateral side strap element 120*b* and medial side strap element 120*c*. The tensioning rings 126 and 130 (or other suitable components) may be provided at other locations along the overall strapping system 104. Additional tensioning systems may be provided at other locations along the overall strapping system 104. As another alternative, if desired, a single tensioning system may be provided, e.g., at the rear heel area, at the front instep area, etc.

As another potential feature, if desired, the securing portions of the lateral strap element 120*b* and the medial strap element 120*c* may overlap one another. More specifically, if desired, the lateral strap element 120*b* may be of substantially the length and structure illustrated in FIGS. 1A and 1B, including its attachment via hook-and-loop fastener 132. The outer surface of the lateral strap element 120*b* may be equipped with a portion of a hook-and-loop fastener (e.g., either a portion of hook-and-loop fastener 128 or another hook-and-loop fastener). The medial strap element 120*c* may be made longer so that its free end extends around the rear heel (optionally through a belt loop type structure) and engages the hook-and-loop fastener provided on the outer surface of the lateral strap element 120*b*. This overlapping of the free ends of straps 120*b* and 120*c* can help provide more hook-and-loop surface area for making the securing connection and help cover the hook-and-loop fastener of one strap beneath the other. These features may help make a more stable and secure connection. As another alternative, if desired, the lateral strap element 120*b* may be made longer and it may overlap and engage a hook-and-loop fastener provided on an outer surface of the medial strap element 120*c*. Other ways of helping maintain a secure connection for strap elements 120*b* and/or 120*c* may be provided without departing from this invention.

Strapping systems 104 in accordance with some examples of this invention may include other features as well. As best shown in FIG. 1B, the strapping system 104 may include a lateral heel strap 134 extending from the tensioning ring 130 toward the plantar support surface of the shoe 100, toward a central, lateral heel location of the upper 102. Similarly, as best shown in FIG. 1C, this example strapping system 104 includes a medial heel strap 136 extending from the tensioning ring 126 toward the plantar support surface of the shoe 100, toward a central, medial heel location of the upper 102. The lateral heel strap 134 and the medial heel strap 136 may constitute opposite ends of a single strap member (e.g., that extends across and beneath the plantar support surface of the shoe, for example, between a bottom surface of the upper 102 (e.g., beneath the bootie element 108, beneath a strobel member, etc.) and a top surface of the sole structure 106). Alternatively, if desired, the lateral heel strap 134 and the medial heel strap 136 may terminate (and constitute separate parts), e.g., secured beneath the plantar support surface of the shoe by stitching, adhesives, mechanical connectors, etc.

Various other features of this example article of footwear are shown in FIGS. 1A through 1C. For example, as shown in FIGS. 1A and 1B, the first strap member 122 (the one extending from the medial ankle opening to the lateral midfoot and/or forefoot area) may be split along its longitudinal direction, e.g., at a location proximate to the lateral midfoot or lateral forefoot area. This is shown in FIGS. 1A and 1B as the area surrounded by strap 122 through which the bootie element 108 is exposed. The split may be provided at or near a location of the fifth toe to improve the natural motion or flexibility of the shoe at that area and to improve the comfort of the strapping system 104 on the foot (by relieving pressure on the little toe when the strapping system 104 is tightened).

Also, as shown in these figures, some or all portions of the strapping system 104 (e.g., rear heel element 120*a*, lateral side strap element 120*b*, medial side strap element 120*c*, first strap member 122, second strap member 124, lateral heel strap 134, and/or medial heel strap 136) may include one or more support fibers or wires 138 attached to or embedded in the fabric or textile material to prevent excessive and/or undesired stretching of the straps and/or to provide support without adding excessive weight. These support fibers or wires 138 may extend generally along a length dimension or direction of the various strapping system 104 components and/or in the general direction in which a tensile or stretching force may be applied when the strapping system 104 is tightened. While these support fibers or wires 138 may be made from any desired materials, in accordance with at least some examples of this invention, the support fibers or wires 138 may be made from steel, copper, aluminum, other metals, carbon fibers, glass fibers, basalt fibers, threads composed of aromatic polyesters produced by the polycondensation of 4-hydroxybenzoic acid and 6-hydroxynaphthalene-2-carboxylic acid (e.g., threads composed of VECTRAN® available from Kuraray Co., Ltd. and/or used in NIKE FLYWIRE® type footwear products), etc.

FIGS. 1A through 1D further illustrate aspects of a sole structure 106 that may be provided in articles of footwear 100 in accordance with at least some aspects of this invention. The sole structure 106 may include various features to improve the natural motion characteristics of an article of footwear 100, as will be described in more detail below.

As shown in these figures, this example sole structure 106 includes a midsole member 150 that may be made from any desired type of material, including materials conventionally known and used in the midsole art, such as polyurethane foam, thermoplastic polyurethanes, vinylethylacetate foams, phylon, phylite, other polymeric foam materials, and the like. The midsole member 150 further may be formed in a conventional manner, such as by injection molding, blow molding, etc. In the illustrated example, the midsole member 150 constitutes a full foam body that extends completely to support the entire foot, heel-to-toe and side-to-side.

The midsole member 150 may be molded (or otherwise formed) to include a plurality of generally transverse flexion grooves 152, particularly in the forefoot area, but even into the midfoot area, if desired. While any desired number of transverse flexion grooves 152 may be provided without departing from this invention, preferably the transverse flexion grooves 152 will be provided at suitable locations so as to support or enhance the natural flex of the foot during a step (running or walking) cycle. This illustrated example sole structure 106 includes four generally transverse flexion grooves 152 running in the footwear medial-to-lateral direction, across the entire midsole member 150. Variations in the flexion groove sizes, shapes, depth, angles, relative angles, and the like may be provided without departing from this invention.

FIG. 1D further shows that this example midsole member 150 includes a generally longitudinal groove 154 located in a heel area of the sole structure 106, e.g., extending substantially along a longitudinal direction of the midsole member 150. This longitudinal groove 154, which may be similar in characteristics to the transverse grooves 152 mentioned above, provides some flexibility in the heel area to promote a more natural motion or feel during a step cycle (running or walking). More specifically, this longitudinal groove 154 allows one side of the heel to flex with respect to the other side of the heel, e.g., during pronation (as the user's weight shifts from the lateral side to the medial side during a step), as the heel lands on the ground, etc.

Notably, as shown in FIGS. 1B through 1D, several of the cleat members 160 located along the perimeter side of the sole structure 106 may be oriented to splay outward somewhat toward the outer perimeter of the sole structure 106 and/or even may be provided somewhat on the side surfaces of cleat bases 158. This outward splay and/or orientation may help provide better traction for athletes while turning, running in non-straight lines, making cuts, etc.

FIGS. 1B through 1D illustrate additional features of sole structures 106 in accordance with at least some examples of this invention. The example sole structure 106 illustrated in these figures is "plateless," which means it lacks a hard or stiff plate material for a base of the sole structure (e.g., that covers a majority of the ground contact surface). This feature helps improve the natural motion feel and characteristics of the sole 106. As mentioned above, the midsole member 150 may be made from a foam material, and as shown in FIGS. 1B through 1D, portions of this midsole member 150 remain exposed to the exterior in this example sole structure 106 (including in grooves 152 and 154). Cleat bearing members 156, including a cleat base member 158 and plural individual cleat elements 160, are provided over the midsole member 150, in this illustrated example in the forefoot and heel areas (the arch or midfoot area remains exposed midsole member 150 in this example sole structure 106). Six total cleat bearing members 156 are shown in this illustrated example. Two cleat bearing members 156 are provided in the heel area, one on the lateral heel side of groove 154 (formed in exposed midsole member 150) and one on the medial heel side of groove 154. Four transverse oriented cleat bearing members 156 are provided in the midfoot/forefoot area. Each of these four transverse midfoot/forefoot cleat bearing members 156 are separated from one another by a transverse groove 152 (formed in exposed midsole member 150). The rearmost transverse cleat bearing member 156 is separated from a remainder of the arch area by rearmost transverse groove 152 (formed in exposed midsole member 150). Although they may be made in other manners as will be described in more detail below, if desired, the cleat bearing members 156 may be engaged with the midsole member 150 by cements or adhesives, by mechanical connectors, or by fusing techniques.

Other numbers of cleat bearing members 156 and/or other shapes, arrangements, or orientations of cleat bearing members 156 may be provided without departing from this invention, and other numbers of grooves 152 and 154 and/or shapes, arrangements, or orientations of grooves 152 and 154 may be provided without departing from this invention. The illustrated numbers and arrangements, however, are useful to enhance the natural motion feel of the footwear 100. Also, the depths of the grooves 152 and 154 and the thickness of midsole 150 material remaining above the grooves 152 and 154 may be appropriately selected so as to enhance the natural motion feel for the footwear. In some examples, the thickness of midsole 150 material remaining above grooves 152 and 154, over at least a majority of the overall lengths of these grooves 152 and 154, may be from about 2.5 to 6 mm thick, and in some examples, from about 2.5 to 4 mm thick. The grooves 152 and 154 may be made sufficiently deep to maintain this thickness of midsole 150 material above the grooves 152 and 154. This feature also is described above in conjunction with dimension "T" in FIG. 4H.

As described above, to enhance the natural motion characteristics of the sole 106, grooves 152 and 154 are molded into the midsole member 150 and the cleat bearing members 156 are arranged between and around these grooves 152 and 154. Natural motion may be achieved or enhanced in other manners as well. For example, FIG. 1D shows that the midfoot/forefoot area of the sole structure 106 includes sipes 162 cut into it. These midfoot/forefoot sipes 162 are oriented to extend generally in the front-to-rear (or longitudinal) direction of the sole structure and are provided to enhance flexibility of the wearer's foot along these sipe lines 162. Three continuous, longitudinal sipes 162 extending substantially the entire midfoot and forefoot length of the sole structure 106 are shown in the example structure of FIG. 1D, and these sipes 162 are provided to generally align between the longitudinally oriented bones of the foot. Other numbers of sipes and orientations thereof could be provided without departing from this invention.

The sipes 162 of this example structure 106 extend through the cleat base members 158 and into the underlying midsole member 150 material (and thus, are shown in FIG. 1D as extending through the groove areas 152 and extending continuously from one cleat bearing member 156 to another). Thus, the sipes 162 of this example construction divide some of the individual cleat bearing members 156 into separate pieces.

The sipes 162 may be deep enough so as to maintain from about 2.5 to 6 mm thick uncut midsole 150 material above the sipes 162, and in some examples, from about 2.5 to 4 mm thick. Also, if desired, the heel oriented groove 154 may include an even deeper sipe cut into it (or this groove 154 could be omitted, if desired, optionally while still leaving midsole member 150 exposed between the heel orientated cleat bearing members 156). One or more sipes or molded-in flex grooves also could extend into the midsole member 150 in the exposed midfoot/arch area, if desired.

Various examples of producing the cleat bearing members 156 and this example plateless sole structure 106 will be described in more detail. First, the cleat bearing members 156 are formed including base surface 158 with a plurality of individual cleat elements 160 extending from the base surface 158. This structure can be formed in any desired manner without departing from this invention, and in this illustrated example, the cleat bearing members 156 may be formed by molding, such as injection molding. In that manner, the base surface 158 and the cleat elements 160 are formed as a unitary, one-piece construction. As other alternatives, if desired, the cleat elements 160 may be separate parts attached to the base surface 158, e.g., by a mechanical connector (e.g., a screw or turnbuckle), by cements or adhesives, etc. While any desired types of materials may be used, in some examples according to this invention, the cleat bearing members 156 are formed from a rubber or thermoplastic polyurethane material.

Once formed, if necessary, the cleat bearing members 156 may be transferred to a second mold, or if necessary, the mold in which the cleat bearing members 156 were formed may be modified to enable formation of the foamed polymer midsole member 150. For example, a plate may be removed from the mold after the cleat bearing members 156 are formed so as to provide a cavity for forming the foamed polymer midsole member 150. In either event, the cleat bearing members 156 are located in a suitable mold and at suitable locations therein so as to then be engaged with a midsole member 150 via a molding process. With the cleat bearing members 156 located in the mold, the polymer midsole material is injected or blown into the mold and thereby engaged with the cleat bearing members 156. The material of the midsole member 150 (e.g., polyurethane foam, thermoplastic polyurethane, ethylvinylacetate foam, phylon, injection phylon, phylite, etc.) and the material of the cleat bearing members 156 may be selected so that the material of the midsole member 150 will react with, bond to, or otherwise combine with the material of the cleat bearing member 156 under the conditions applied during the molding step (or during a post molding step), e.g., temperature, pressure, dwell time, etc.

At least the midsole material, and optionally both the midsole material and the cleat bearing members 156 may be shaped to their final desired shape(s) during this combined molding and/or pressing process. This may include, for example, shaping the foamed polymer material to include the transverse flex grooves 152 in the foamed polymer material at a forefoot area and/or a midfoot area of the sole structure and/or the longitudinal flex groove(s) 154 at the rear heel area. Thus, in the final sole structure 106, the cleat bearing members 156 may be separated from one another by the flex grooves 152, 154 molded into the midsole member 150.

While it may be possible to also mold the longitudinal sipes 162 into the cleat bearing members 156 and the midsole member 150, in accordance with at least some examples of this invention, these sipes 162 will be cut through the cleat bearing members 156 and/or the midsole member 150 after the molding step is completed and after the cleat bearing members 156 are engaged with the midsole member 150. This cutting can take place in various ways, such as using a hot knife or blade to cut in the sipes 162 (optionally a two or three dimensional blade to cut all sipes in a single process), laser cutting in the sipes 162, mechanical cutting (e.g., using a rotating blade saw), localized melting (e.g., RF welding), etc. Cutting may allow formation of a somewhat narrower groove than a typical molding process.

Figure 2B:
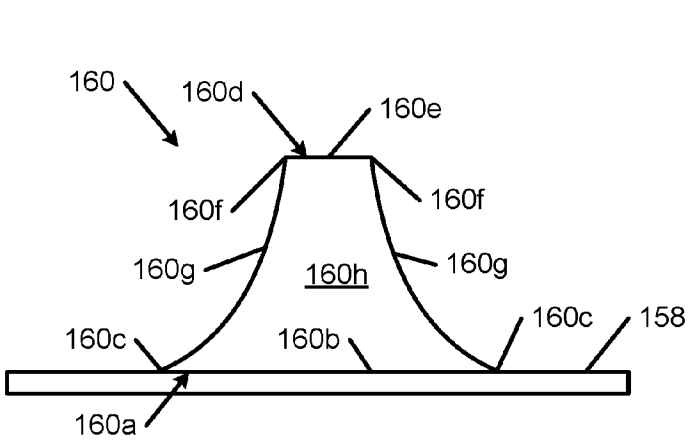
FIGS. 2A through 2C illustrate various views of an example cleat and cleat bearing member that may be provided in articles of footwear according to some aspects of this invention.
Figure 2A:
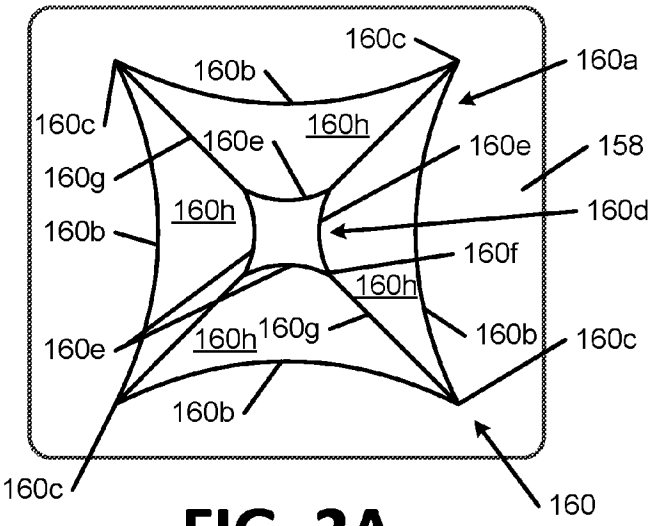
Figure 2C:
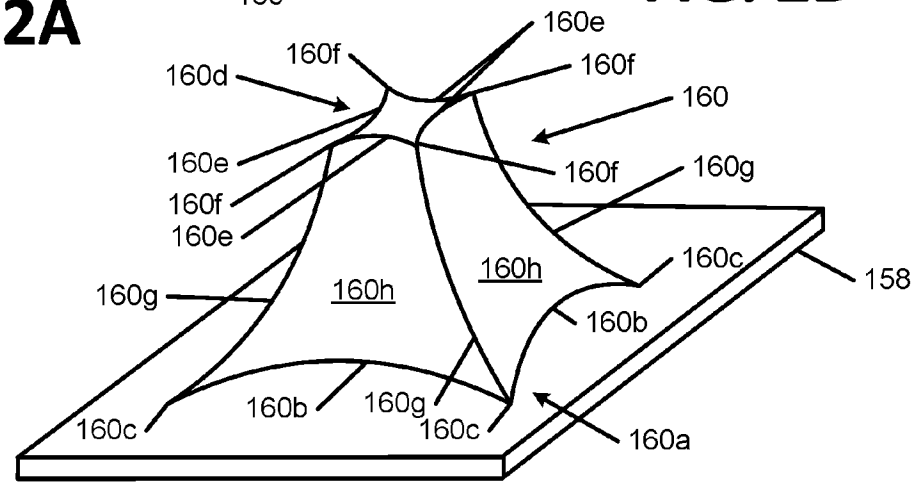

While any desired cleat construction may be used, FIGS. 2A through 2C illustrate one example cleat base member 158 and cleat 160 structure that may be used in accordance with at least some examples of this invention. As shown in these figures, the cleat 160 itself may include a cleat base 160*a* where the cleat 160 extends from (or attaches to) the cleat base member 158. The outer perimeter of this illustrated cleat base 160*a* constitutes a closed geometric shape having from three to five inwardly curved sides 160*b* and three to five corner regions 160*c* joining adjacent sides 160*b*. Four sides 160*b* and four corner regions 160*c* are shown in the example structure of FIGS. 2A through 2C.

The cleat 160 further includes a cleat end surface 160*d*, i.e., the outermost surface of the cleat 160 that engages the contact surface in use. An outer perimeter of the cleat end surface 160*d* likewise constitutes a closed geometric shape having from three to five inwardly curved sides 160*e* and three to five corner regions 160*f* joining adjacent sides 160*e*, wherein the closed geometric shape of the cleat base 160*a* has the same number of sides and corner regions as the closed geometric shape of the cleat end surface 160*d* (four in this example). The closed geometric shape or outer perimeter of the cleat end surface 160*d* encloses a smaller area than the closed geometric shape or outer perimeter of the cleat base 160*a*.

A cleat body extends between the cleat base 160*a* and the cleat end surface 160*d*. This cleat body includes a plurality of edges 160*g* extending between corner region 160*c* of the cleat base 160*a* and corresponding corner regions 160*f* of the cleat end surface 160*d*. While they may be straight or outwardly curved, if desired, in this illustrated example, the edges 160*g* of the cleat body are curved inwardly (toward an interior of the cleat 160). The cleat body further defines side walls 160*h* extending between adjacent edges 160*g* of the cleat body. While they also may be straight or outwardly curved, if desired, in the illustrated example, these side walls 160*h* are inwardly curved. The inward curvatures of these various parts may help the cleats 160 better penetrate the ground and/or engage the material of other contact surfaces. The specific extent of these various curvatures and their overall shapes (e.g., as a radius, as a parabola, as another arch, as stepped line segments, etc.) may vary widely without departing from this invention.

Figures 3A, 3B:
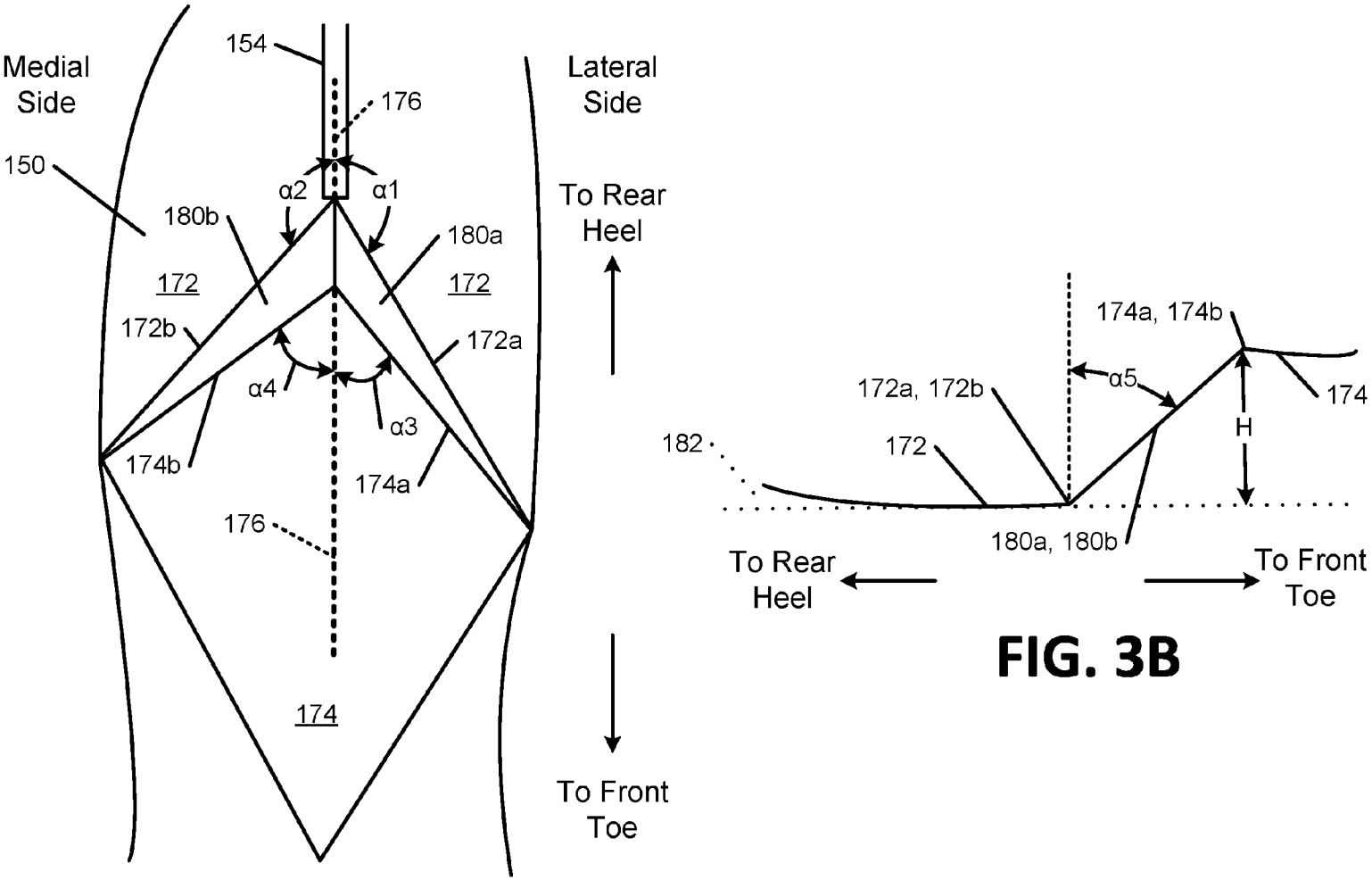
FIGS. 3A through 3D illustrate various views of an example heel "pocket-like" traction element that may be provided in articles of footwear according to some aspects of this invention.

FIGS. 3A and 3B illustrate another example feature or aspect of a sole structure that may be incorporated into articles of footwear according to this invention (including in the sole structure 106 of FIG. 1D). FIGS. 3A and 3B illustrate the junction area between the heel and arch portions of the midsole member 150 (e.g., area 170 shown in FIG. 1D) with the cleat structures removed. Thus, these figures show the major surface 172 of the heel area of the midsole member 150 (also called the "heel area surface member" in this specification) and the major surface 174 of the arch area of midsole member 150 (also called the "arch area surface member"). These figures, along with FIG. 1D, illustrate an elevation change between a portion of the heel and the arch areas of the sole. This aspect of the invention will be described in more detail below.

FIG. 3A illustrates that the heel area surface member 172 of this example includes a lateral forward edge 172*a* extending at an oblique angle $\alpha 1$ from a longitudinal direction 176 of the sole. This lateral forward edge 172*a* extends from a central heel area of the heel area surface member 172 to a location proximate a lateral side of heel area surface member 172. The heel area surface member 172 of this example further includes a medial forward edge 172*b* extending at an oblique angle $\alpha 2$ from the longitudinal direction 176 of the sole. This medial forward edge 172*b* extends from the central heel area of the heel area surface member 172 to a location proximate a medial side of heel area surface member 172.

The angles angle $\alpha 1$ and $\alpha 2$ may be the same or different, but in this illustrated example, $\alpha 1 > \alpha 2$. Each of $\alpha 1$ and $\alpha 2$ may range from 110° to 170°, and in some examples from 120° to 165° or even from 130° to 165°.

FIG. 3A further shows that the arch area surface member 174 of this example structure includes a lateral rearward edge 174*a* extending at an acute angle α3 from the longitudinal direction 176 of the sole. This lateral rearward edge 174*a* extends from a central rear location of the arch area surface member 174 to a location proximate a lateral side of arch area surface member 174. The illustrated arch area surface member 174 of this example further includes a medial rearward edge 174*b* extending at an acute angle α4 from the longitudinal direction 176 of the sole. As shown in the figure, this medial rearward edge 174*b* extends from the central rear location of the arch area surface member 174 to a location proximate a medial side of arch area surface member 174.

The angles α3 and α4 may be the same or different, but in this illustrated example, α4>α3. Each of angles α3 and α4 may range from 25° to 75°, and in some examples from 30° to 70° or even from 35° to 65°. Furthermore, the lateral forward edge 172*a* and the medial forward edge 172*b* of the heel area surface member 172 of this illustrated example may define an acute angle, e.g., within the range of 40° to 85°, and in some examples, from 50° to 80° or even from 60° to 80°. The lateral rearward edge 174*a* and the medial rearward edge 174*b* of the arch area surface member 174 also may form an acute angle falling within the same general ranges described above for the lateral forward edge 172*a* and the medial forward edge 172*b* of the heel area surface member 172.

To make the elevation change between the heel area surface member 172 and the arch area surface member 174, at least in the central portion of the sole structure, the lateral forward edge 172*a* of the heel area surface member 172 and the lateral rearward edge 174*a* of the arch area surface member 174 are joined together by a first side wall 180*a*. Additionally, the medial forward edge 172*b* of the heel area surface member 172 and the medial rearward edge 174*b* of the arch area surface member 174 are joined together by a second side wall 180*b*. These side walls 180*a* and 180*b* may be angled in a forward/top-to-rear/bottom direction, as further shown in FIG. 3B (which constitutes a side cross sectional view of the heel/arch area of the midsole member 150 at an arbitrary location along walls 180*a*, 180*b*). The side wall angle α5, with respect to a vertical line (with the sole sitting on a contact surface 182), may be in the range of 20° to 80°, and in some examples between 30° and 75° or even between 40° and 70°.

In at least some sole structures in accordance with this invention, a height dimension H of the side walls 180*a* and 180*b* may taper from a greatest height at its interior-most location (e.g., at the central heel area) to a smallest height or zero height at its side end. This tapering may leave the side walls 180*a* and 180*b* to have a generally triangular exposed surface, as shown in FIGS. 1D and 3A. The height dimension H may vary in articles of footwear to a maximum height, for example, in the range of 6 to 20 mm.

While they may be made from multiple parts that are bonded together or otherwise held together in a final sole or shoe structure, in this example of the invention, the heel area surface member 172, the arch area surface member 174, the lateral side wall 180*a*, and the medial side wall 180*b* are formed as a unitary, one piece construction, e.g., by a molding step, such as those described above. As noted above, these parts (and indeed the entire midsole member 150) may be made from any desired materials, such as polyurethane foam material, thermoplastic polyurethane material, or ethylvinylacetate foam material, including conventional midsole materials as are known in the art.

The angular arrangement and orientation of the edges 172*a*, 172*b*, 174*a*, and 174*b*, and the elevation changes introduced by the side walls 180*a* and 180*b* produce an edge or pocket-like structure in the rear heel area of this example sole structure 106. This pocket-like structure helps provide traction, particularly for an athlete backpedalling or running in a backward direction, by providing an elevated surface that can engage the ground or other contact surface and help push off against it. By tapering to a thin or zero thickness near the medial and lateral side edges of the sole, the sole structure still provides a solid and stable feel (and the athlete does not feel as if he or she is trying to run on high heeled shoes).

Figures 3C, 3D:
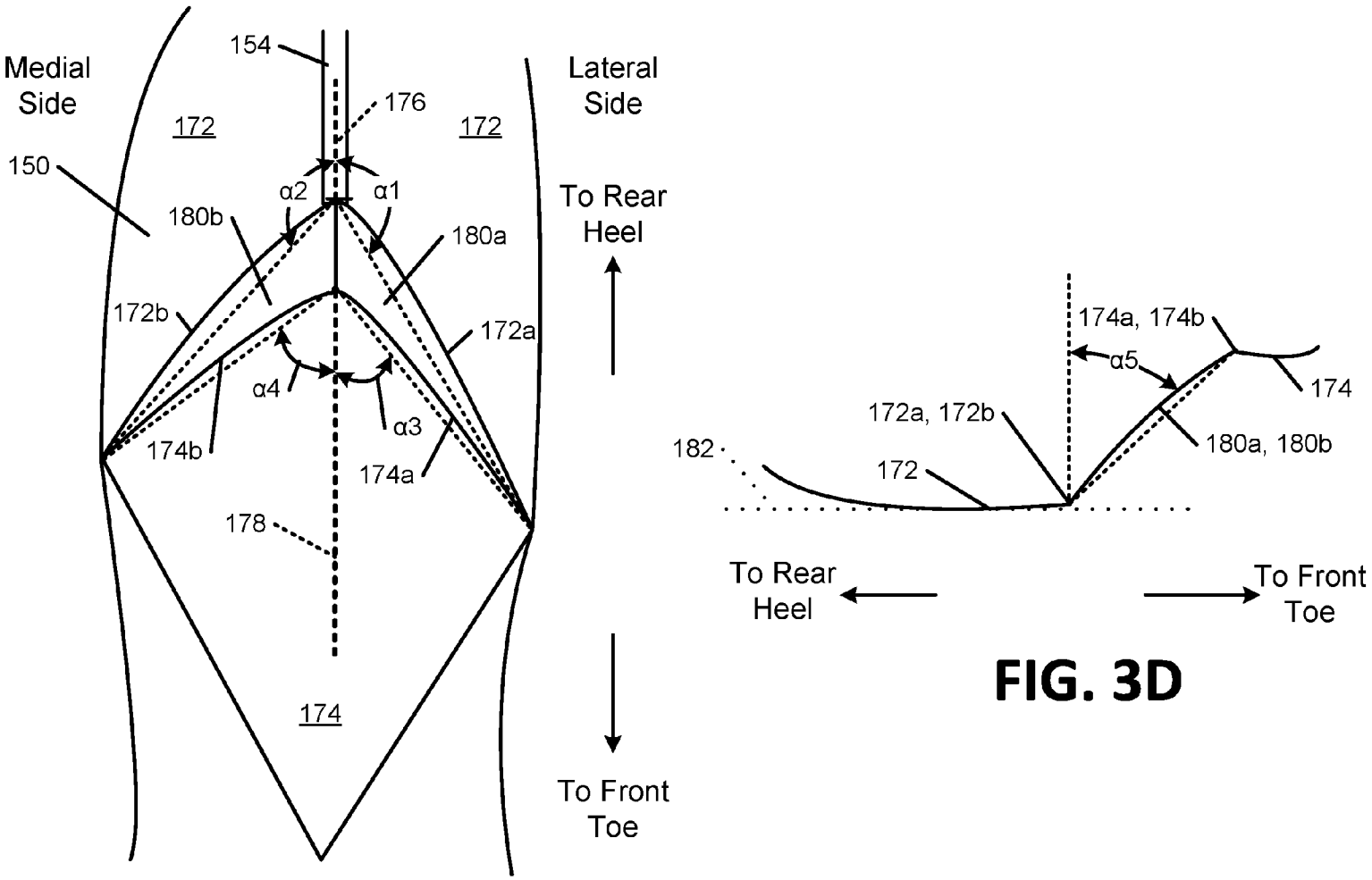

In the example structure shown in FIGS. 3A and 3B, the various edges 172*a*, 172*b*, 174*a*, and 174*b*, as well as the side walls 180*a* and 180*b* are straight (non-curved). This is not a requirement. As shown in FIGS. 3C and 3D, some or all of these edges and walls may be curved in any desired direction. When curved, nonetheless, the various angles and measurements may be made based on straight line segments that connect the ends of the various curved edges 172*a*, 172*b*, 174*a*, and 174*b* and walls 180*a* and 180*b*. The line segments from which measurements may be made (to determine the various angles αs mentioned above) are shown as dashed lines in FIGS. 3C and 3D, while the actual edges and walls are shown as solid lines.

Figure 4A:
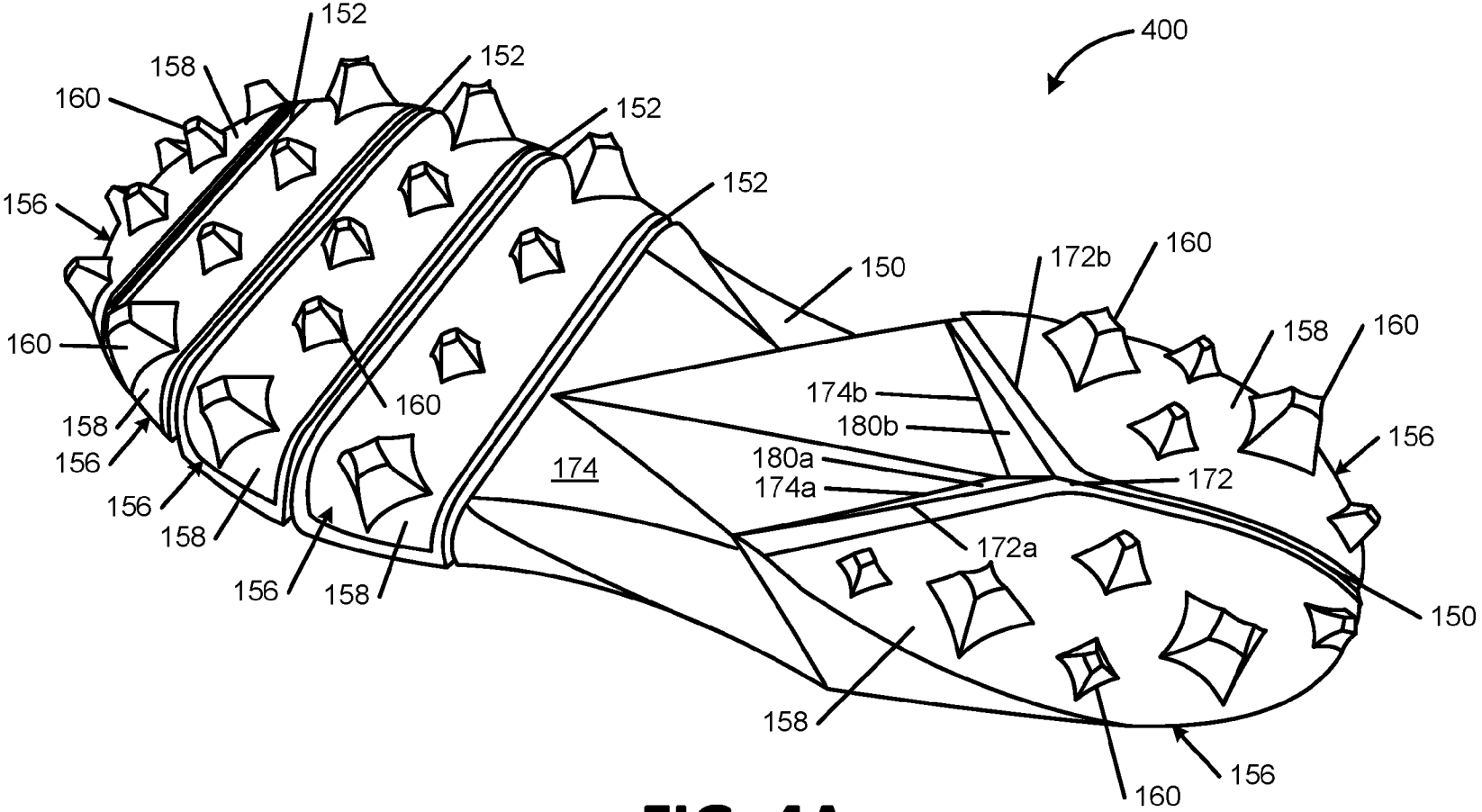
FIGS. 4A through 4N provide various views of an example sole structure that includes various features in accordance with aspects of this invention.
Figure 4B:
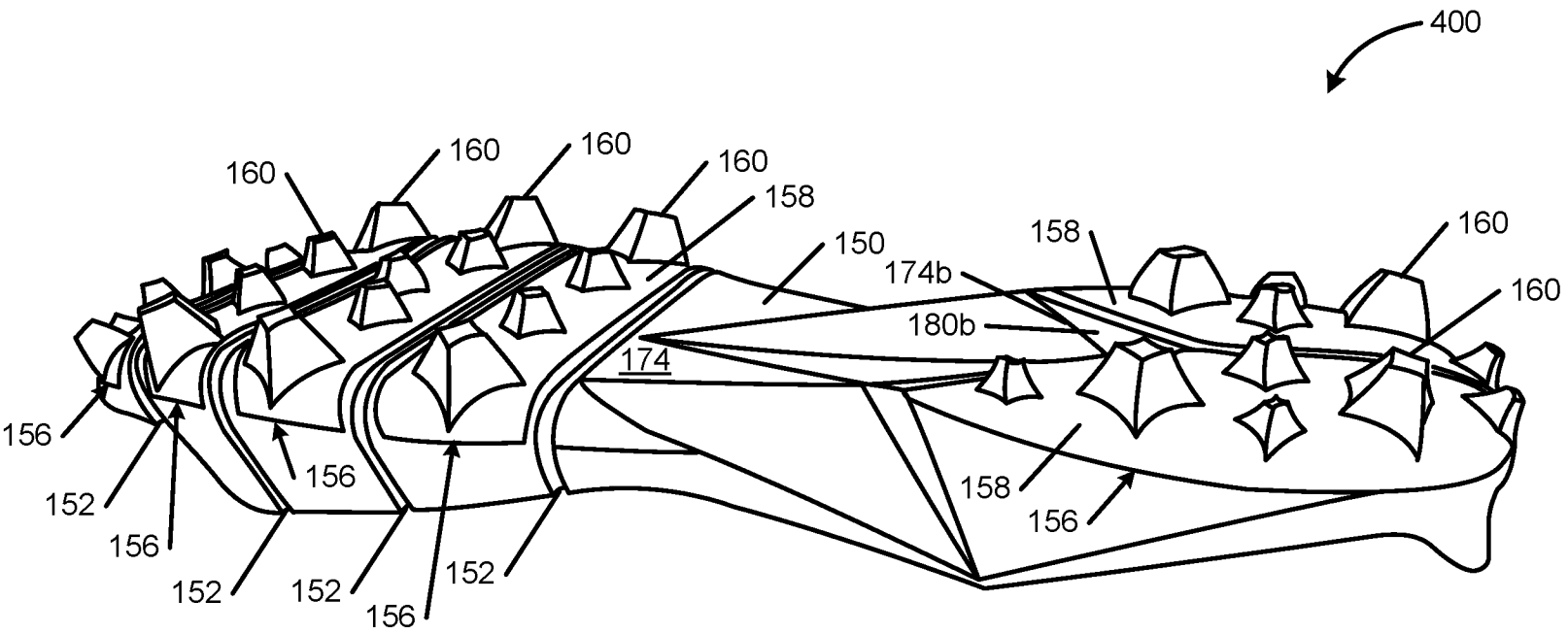
Figure 4D:
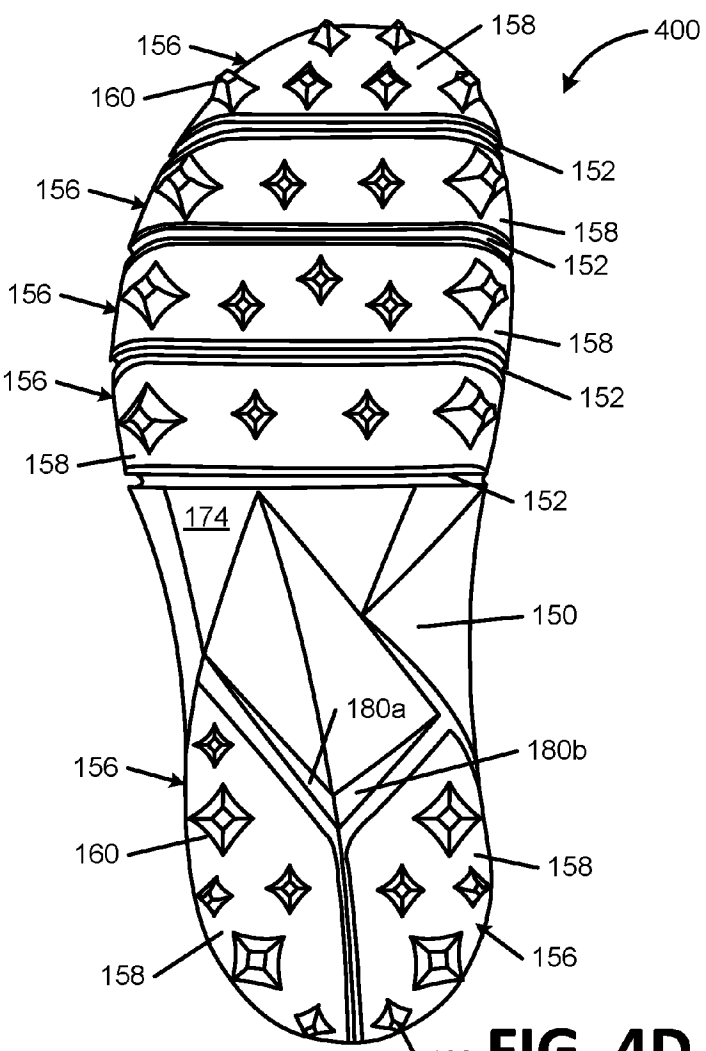
Figure 4C:
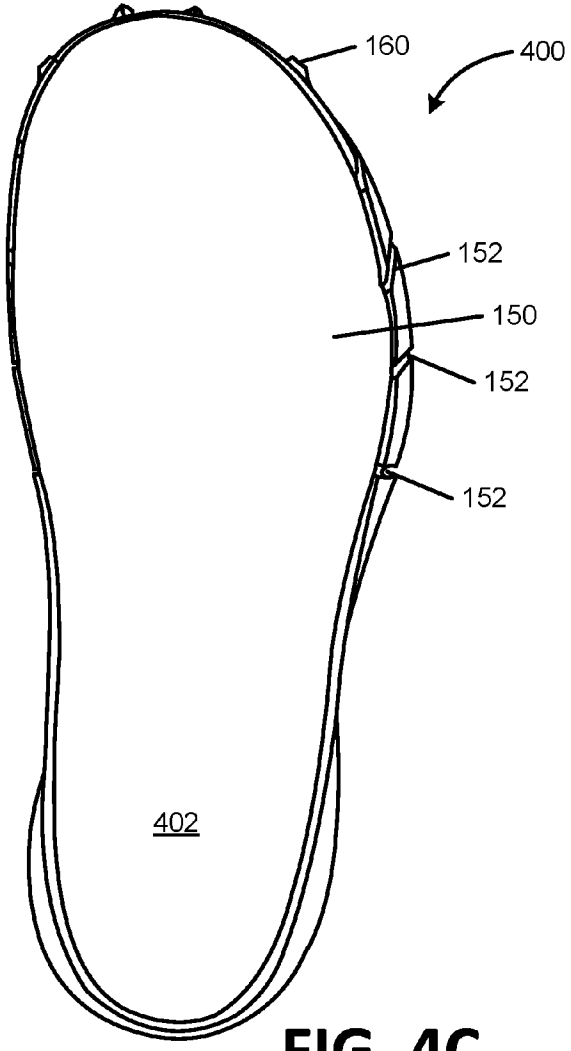
Figure 4G:
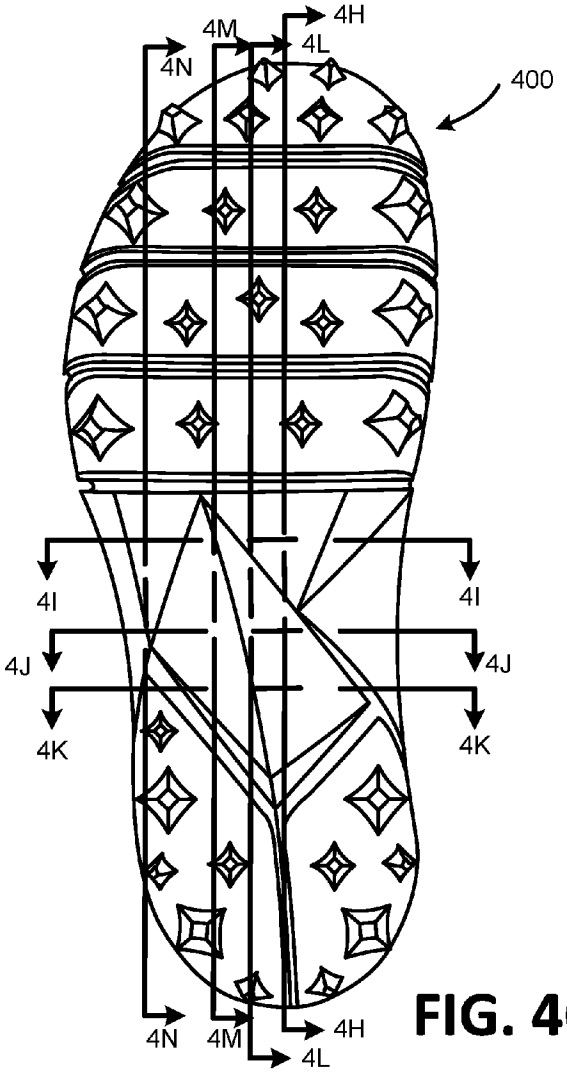
Figure 4F:
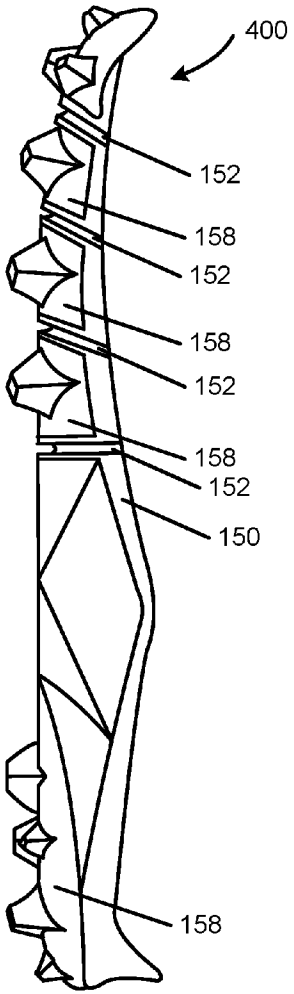
Figure 4E:
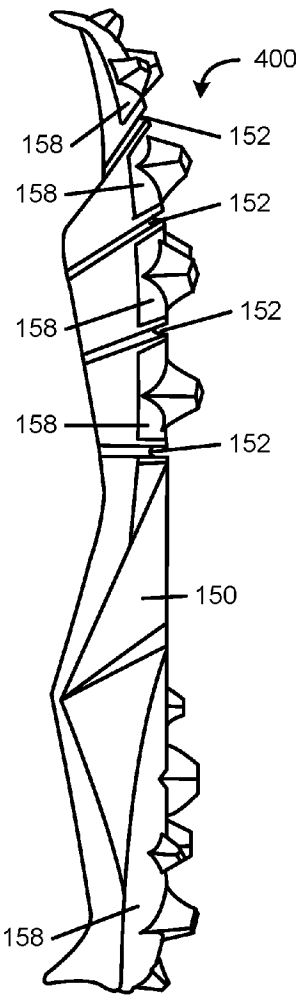
Figure 4I:
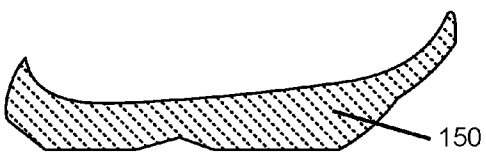
Figure 4J:
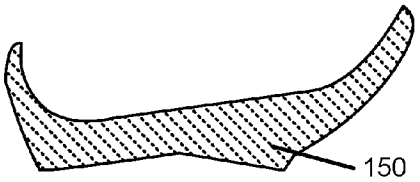
Figure 4K:
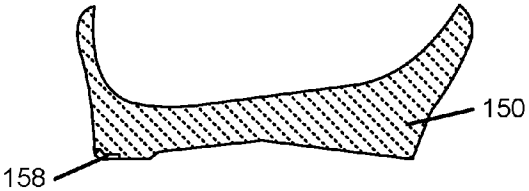
Figure 4H:
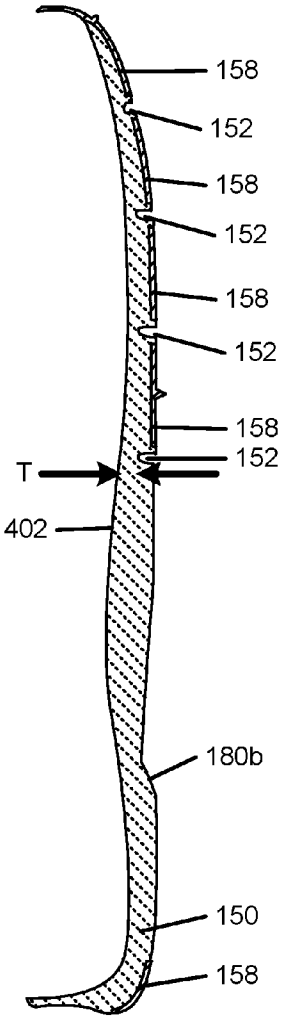
Figure 4L:
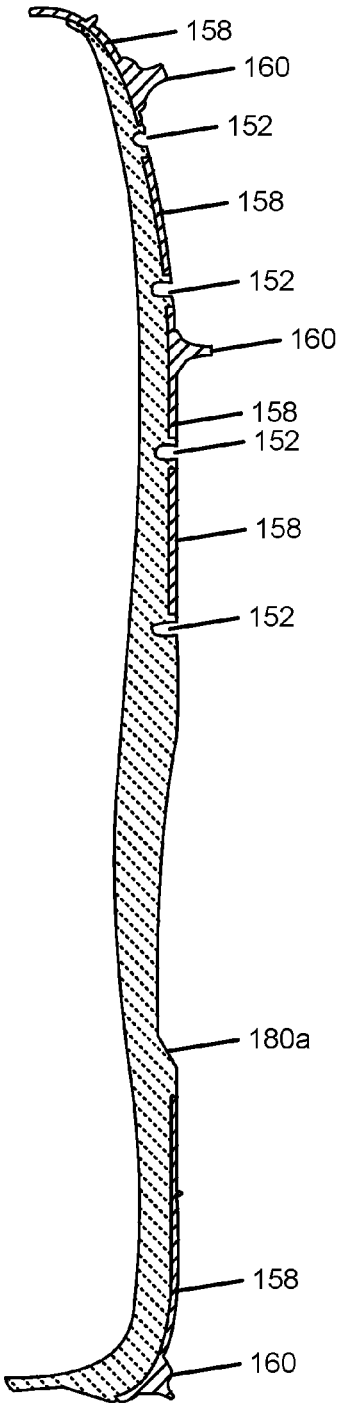
Figure 4M:
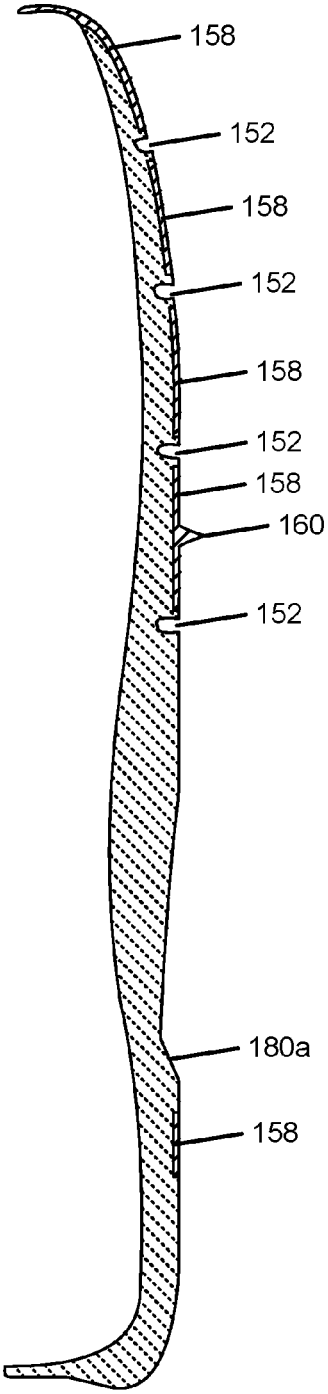
Figure 4N:
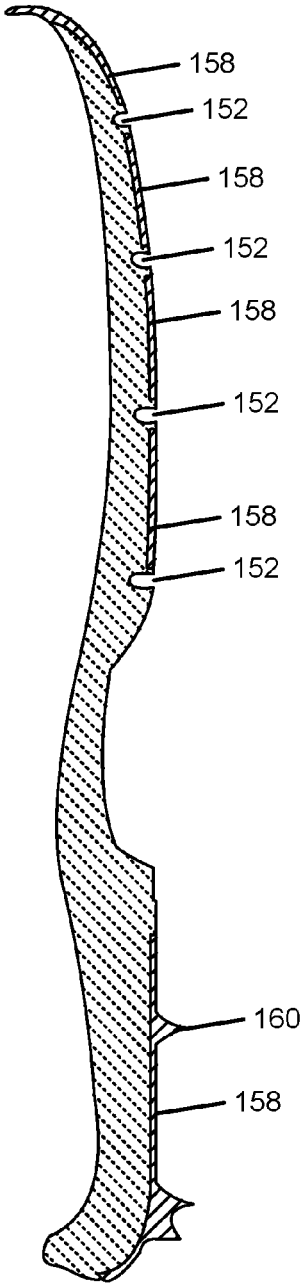

The sole structure 106 of FIGS. 1A through 1D is designed more for use on artificial grass type playing surfaces, such as FieldTurf artificial turf or other synthetic surfaces (although it could be used on natural grass as well). Aspects of this invention also may be advantageous for use on footwear designed for play on natural grass. FIGS. 4A through 4N show various views of a sole structure 400 for an article of footwear that may be well suited for use on natural grass (but could be used on artificial turf as well). The views include: (a) FIG. 4A—perspective view, (b) FIG. 4B—another perspective view, (c) FIG. 4C—top view (showing an interior foot support surface 402), (d) FIG. 4D—bottom view, (e) FIG. 4E—lateral side view, (f) FIG. 4F—medial side view, (g) FIG. 4G—bottom view with section lines, and (h) FIGS. 4H through 4N—section views taken along the various section lines shown in FIG. 4G. This sole structure 400 may be used with any desired type of upper, including uppers and/or strapping systems, e.g., of the various types described above and those that will be described in more detail below.

The sole structure 400 of FIGS. 4A through 4N may be similar in structure, materials, orientations, and construction to the sole structure 106 described above in conjunction with FIGS. 1A through 1D. Thus, sole structure 400 may include a similar midsole construction 150, cleat bearing members 156 (including cleat bases 158 having a plurality of cleats 160 extending therefrom), transverse flex lines 152, heel area surface member 172, arch area surface member 174, side walls 180*a* and 180*b*, and the "pocket-like" rear heel area. These common features are labeled in FIGS. 4A through 4N with common reference numbers to those used above in FIGS. 1A through 3D, and the detailed description of these various parts will be omitted for clarity and brevity. A main difference in this sole structure 400 as compared to the sole structure 106 of FIGS. 1A through 1D relates to the overall number of cleats (fewer in the structure 400) and the differences in sizes of these cleats (larger cleats 160 and larger differences in cleat sizes in structure 400).

Notably, as shown in FIGS. 4A, 4B, 4D, 4E, and 4F, several of the cleat members 160, and particularly those located along the perimeter side of the sole structure 400 are somewhat larger than the cleat members 160 of the sole structure 106 shown in FIGS. 1A through 1D. These larger cleat members 160 may provide better traction for engaging the ground under varying conditions (e.g., wet conditions in which the cleat members 160 might sink into the ground more). Additionally, as shown in these figures, the larger perimeter or side cleat members 160 may be oriented to splay outward somewhat toward the outer perimeter of the sole structure 400 (e.g., at least for the larger, outer perimeter cleat members 160 in the forefoot and/or rear heel areas). This outward splay may help reduce or moderate the stud pressure and improve comfort. Additionally, this outward splay may help provide better traction for athletes while turning, running in non-straight lines, making cuts, pushing off, etc.

Not all cleat members on a given shoe sole need have the general structure or configuration shown in FIGS. 2A through 2C. For example, in this sole structure 400, the intermediate cleat members 160 between the larger side edge cleat members 160 may have a somewhat different configuration, may be reduced in number, and/or may even be removed. Changing the configuration, orientation, and/or number of these intermediate cleats can help keep the cleats clear of mud and grass (which can tend to stick between cleats, particularly if cleat elements 160 are located too close together for the natural turf conditions).

As described above, the thickness of midsole member 150 remaining above the grooves 152 and/or 154 may be from 2.5 to 6 mm thick, and in some examples, from about 2.5 to 4 mm thick. This thickness is illustrated, for example, in FIG. 4H, as dimension "T" shown between the midsole member 150 support surface 402 and the top of a groove 152. Also, while not shown in FIGS. 4A through 4N, this example sole structure 400 also may include cut in sipes (e.g., in generally the longitudinal direction), e.g., like sipes 162 shown in FIG. 1D. These sipes, when present, may be provided with the same specifications and/or in the same manners as described above for sipes 162.

If desired, the sipes 162 can be cut into the sole structure 106, 400 as a post-manufacturing process, optionally in a customized manner to suit a particular wearer's preferences. For example, if a wearer wants a greater natural motion feel, deeper and/or more sipes 162 can be made, both in the generally longitudinal and transverse directions, as well as in other directions. The sole structure 106, 400 could be marked or scored with appropriate indicia (on base surfaces 158) to allow the wearer to cut in the desired sipes 162 at the appropriate locations on their own. Additionally, if desired, the footwear could be sold as a kit (or the kit could be sold separately), wherein the kit includes one or more knife elements with instructions as to how to cut in the desired sipes 162 (e.g., by a hot knifing method). As another alternative, a user could take his or her shoes to a retail or other location to have the sipes 162 cut in to their specifications.

Figure 5A:
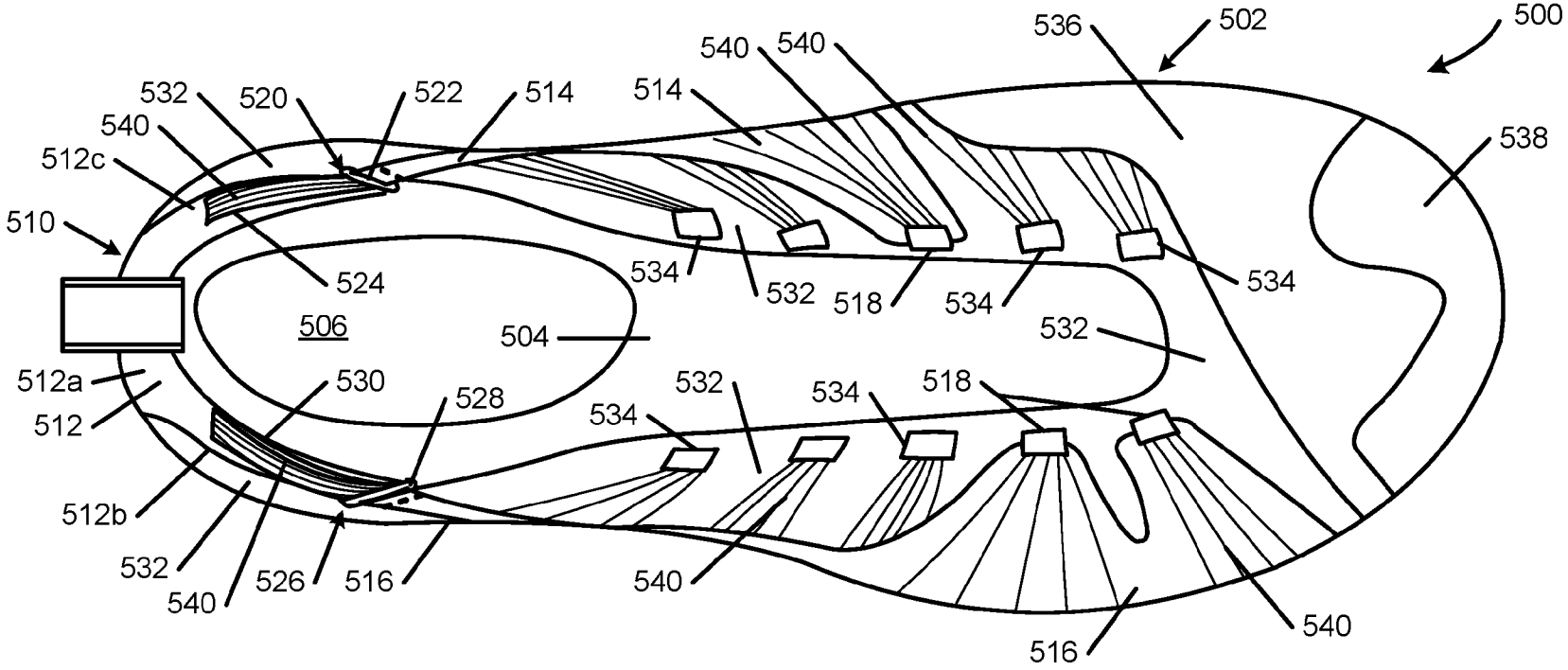
FIGS. 5A through 5C provide various views of another example article of footwear including various features and aspects of this invention.
Figure 5B:
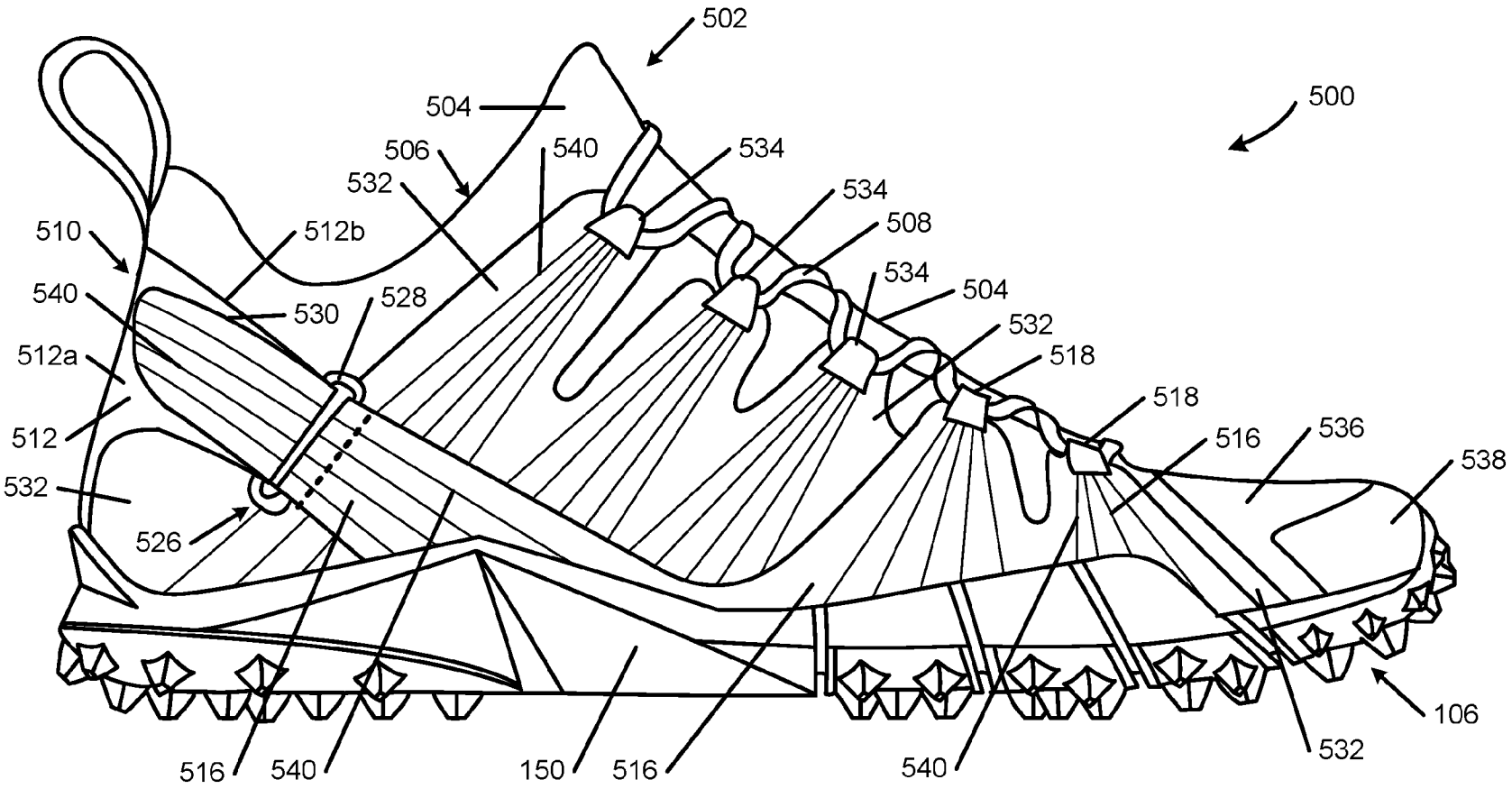
Figure 5C:
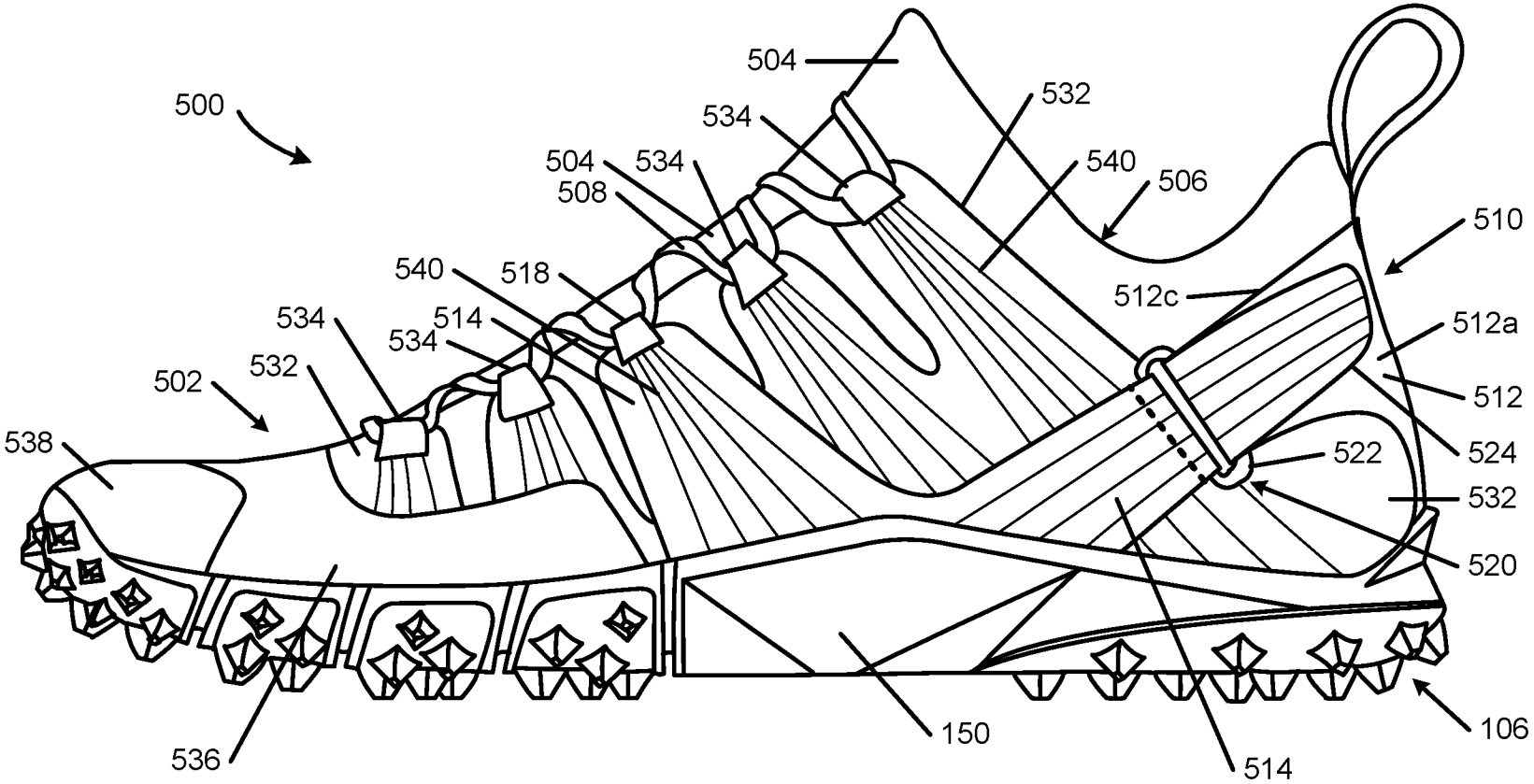

FIGS. 1A through 1D show an upper and strapping system used in an overall footwear structure that does not include a conventional lace securing system (although, as noted above, if desired, a conventional lace type securing system could be included with that upper and/or strapping system). FIGS. 5A through 5C show top, lateral, and medial side views, respectively, of an article of footwear 500 in which the upper 502 includes structures for engaging a lace type securing system. While this upper 502 may be used with any desired type of footwear sole construction, in the illustrated example, the sole structure is similar to that shown in FIGS. 1A through 1D, so a further detailed description of this example sole structure 106 is omitted. Those skilled in the art, given the benefit of this disclosure, will recognize that the sole structure of the article of footwear 500 of FIGS. 5A through 5C may be like sole structure 400 (e.g., of FIG. 4A through 4N) or have any other desired configuration, including cleated or non-cleated.

As shown in FIGS. 5A through 5C, this example upper 502 includes a bootie element 504 that defines an ankle opening 506 for receiving a wearer's foot and at least partially defines an interior chamber for holding (and directly contacting) the wearer's foot. If desired, the bootie element 504 may form the complete interior chamber of the shoe, although it need not do so (e.g., the bottom of the interior chamber may be formed from an insole or sock liner type member, a strobel member, etc.). Notably, as shown in these figures, the bootie element 504 is exposed in an instep area across a midfoot area of the upper 502. Thus, in this manner, the bootie element 504 modulates the pressure and feel of the lace element 508 when the article of footwear 500 is secured to a wearer's foot. Additionally or alternatively, if desired, a more conventional tongue element could be included in the instep area of the footwear structure 500, without departing from the invention.

The upper 502 shown in FIGS. 5A through 5C includes a strapping system 510 that, at least in part, helps secure the article of footwear 502 to the wearer's foot. The strapping system 510 of this illustrated example includes three major components, namely: (a) a rear heel strap member 512, a first (medial) side strap member 514, and a second (lateral) side strap member 516. These components of the strapping system 510 may be made from the same materials, from the same constructions, and/or in the same manners as the components of strapping system 104 described above in conjunction with FIGS. 1A through 1C (e.g., the same as components 120, 122, and 124). More specific example features of these strapping system 510 components will be described in more detail below.

The rear heel strap member 512 may be engaged with or integrally formed with the rear heel area of the upper 502. This example rear heel strap member 512 includes: (a) a rear heel element 512*a*, (b) a lateral side strap element 512*b* that extends from the rear heel element 512*a* and along the lateral side of the upper 502 and/or the ankle opening 506, and (c) a medial side strap element 512*c* that extends from the rear heel element 512*a* and along the medial side of the upper 502 and/or the ankle opening 506. While they may be made from multiple pieces (e.g., joined together by stitching or sewing, etc.), in this illustrated example, the rear heel element 512*a*, the lateral side strap element 512*b*, and the medial side strap element 512*c* are formed as a unitary, one piece construction.

FIGS. 5A and 5C show additional details of this example first (medial side) strap member 514. As shown, this strap member 514 extends along the medial side of the upper 502 to a medial midfoot area of the upper 502. This first strap member 514 further includes at least one structure for engaging lace 508 (and in this illustrated example, a single structure for engaging lace 508). While any desired type of structure for engaging a lace may be provided without departing from this invention (e.g., including a conventional opening or eyelet type structure), in this illustrated example, the free end of the strap member 514 defines or includes a short "tunnel" type opening 518 (e.g., approximately ¼ to ¾ inches long, made of fabric) through which the lace 508 extends. The tunnel type opening 518 runs substantially parallel to the surface of the upper 502 along which it is provided (as opposed to an eyelet type opening that extends perpendicular to the surface on which it is provided). The tunnel type openings 518 tend to put somewhat less localized force or pressure on the instep area of the wearer's foot when the lace 508 is tightened.

Additional details of the second (lateral side) strap member 516 are shown in FIGS. 5A and 5B. This second strap member 516 extends along the lateral side of the upper to a lateral midfoot area of the upper 502, and if desired, to a lateral forefoot area of the upper 502. The second strap member 516 of this example further includes at least two structures for engaging the lace 508 (and in this illustrated example only two structures for engaging the lace 508). The structures for engaging the lace 508 on this second strap member 516 may be tunnel like openings 518 like those described above for the first strap member 514 (although other structures could be used, if desired, including conventional eyelet type structures). While other arrangements are possible, in this illustrated example, the two structures 518 for engaging the lace 508 provided with the second strap member 516 are located closer to a forward-most location of the article of footwear 500 (i.e., closer to the toe or farther forward in the longitudinal direction) than the structure 518 for engaging the lace 508 provided with the first strap member 514. This arrangement provides a comfortable feel while also providing support for the lateral side of the foot during use of the shoe, such as during a cut or quick direction change maneuver.

Strap members 514 and 516 may constitute independent and separate parts that are fastened between the plantar support surface of the shoe and a top surface of the midsole member 150. As a more specific example, the strap members 514 and 516 may wrap somewhat underneath the plantar support surface (e.g., at least 8 mm beneath the plantar support surface) and be fastened to the plantar support surface and/or the midsole member 150 at that location (e.g., by sewing or stitching, by adhesives or cements, etc.). Alternatively, if desired, strap members 514 and 516 may constitute opposite sides of a single strap member that extends beneath the plantar support surface completely from the medial side to the lateral side thereof.

Strapping system 510 further includes one or more tensioning systems for securing the article of footwear 500 with a wearer's foot. In this illustrated example, a first tensioning system 520 is provided for engaging the medial side strap element 512*c* of the rear heel strap member 512 with the first (medial side) strap member 514. This tensioning system 520 includes a tensioning ring 522 engaged with a free end of the first strap member 514 (e.g., by sewing or stitching). The free end of the medial side strap element 512*c* of the rear heel strap member 512 runs through the opening of the tensioning ring 522 and folds back over itself. In this condition, a hook-and-loop fastener 524 (or other securing mechanism) may be engaged (one portion of the hook-and-loop fastener 524 being provided at the free end of medial side strap element 512*c* and one portion of the hook-and-loop fastener 524 being provided on a surface of the rear heel strap member 512).

A second tensioning system 526 is provided for engaging the lateral side strap element 512*b* of the rear heel strap member 512 with the second (lateral side) strap member 516. This tensioning system 526 includes a tensioning ring 528 engaged with a free end of the second strap member 516 (e.g., by sewing or stitching). The free end of the lateral side strap element 512*b* of the rear heel strap member 512 runs through the opening of the tensioning ring 528 and folds back over itself. In this condition, a hook-and-loop fastener 530 (or other securing mechanism) may be engaged (one portion of the hook-and-loop fastener 530 being provided at the free end of lateral side strap element 512*b* and one portion of the hook-and-loop fastener 530 being provided on a surface of the rear heel strap member 512).

Other tensioning system(s) structures and constructions may be provided without departing from this invention. For example, if desired, the hook-and-loop fastening components 524 and 530 may be provided on first and second strap members 514 and 516 instead of (or in addition to) those provided on lateral side strap element 512*b* and medial side strap element 512*c*. The tensioning rings 522 and 528 (or other suitable components) may be provided at other locations along the overall strapping system 510. More tensioning systems may be provided at other locations along the overall strapping system 510. As another alternative, if desired, a single tensioning system may be provided, e.g., at the rear heel area, etc. The strapping system also may include downwardly oriented strap components, like components 134 and 136 shown in FIGS. 1A through 1C. Additionally, the free ends of the strap elements 512*b* and/or 512*c* may wrap around the rear heel and overlap the other strap element, as described above.

FIGS. 5A through 5C further illustrate that the upper 502 may include a shell member 532 that, at least in part, covers the interior bootie member 506. The shell member 532, which may be formed from one or more parts (that are connected together or separate from one another), may provide the exposed exterior of a substantial portion of the upper 502, and may even constitute the exposed exterior of a majority of the exposed surface area of the upper 502. Shell member 532 may be made from a fabric or lightweight polymeric material and may serve to improve wear and abrasion resistance, protect the bootie member 506, provide support or structure to the upper, or perform other desired functions. The shell member(s) 532 of this illustrated example further underlie the various parts of the strapping system 510, e.g., to protect the underlying bootie member 506 at these positions, to modulate the "feel" of the straps, etc. The shell member(s) 532 may cover as much of the bootie member 506 and provide as much of the exterior surface area of the upper 502 as desired.

The shell member(s) 532 also may provide structures 534 for engaging the lace 508, as shown in FIGS. 5A through 5C. These lace engaging structures 534 may have the same or similar construction to the "tunnel" like elements 518 provided on the straps 514 and 516, or they may have other structures. Thus, in the illustrated example, the upper 502 includes structures 534 for engaging the lace 508 that are not included as part of the first strap member 514 or the second strap member 516 (while these strap members 514 and 516 also include structures 518 for engaging the lace 508).

Using tensioning systems 520 and 526 and lace 508 (extending through lace receiving elements 518 and 534), the wearer can securely fasten this article of footwear 500 to his/her foot.

FIGS. 5A through 5C illustrate additional features that may be included in uppers 502 according to this example of the invention. As shown, the forefoot area of this example upper 502 includes an additional protective covering 536 (or a different shell member component or material) to provide protection over the wearer's forefoot, to provide wear and abrasion resistance, to provide durability, to protect the bootie element 504, etc. FIGS. 5A through 5C also show a protective toe cap 538 over the extreme toe area of the article of footwear 500.

Also, as shown in FIG. 5A through 5C, some or all portions of the strapping system 510 and/or the shell member(s) 532 may include one or more support fibers or wires 540 to prevent excessive and/or undesired stretching of these components and/or to provide support without adding excessive weight. These support fibers or wires 540 may be of the types described above in conjunction with element 138 in FIGS. 1A through 1C.

Figure 6:
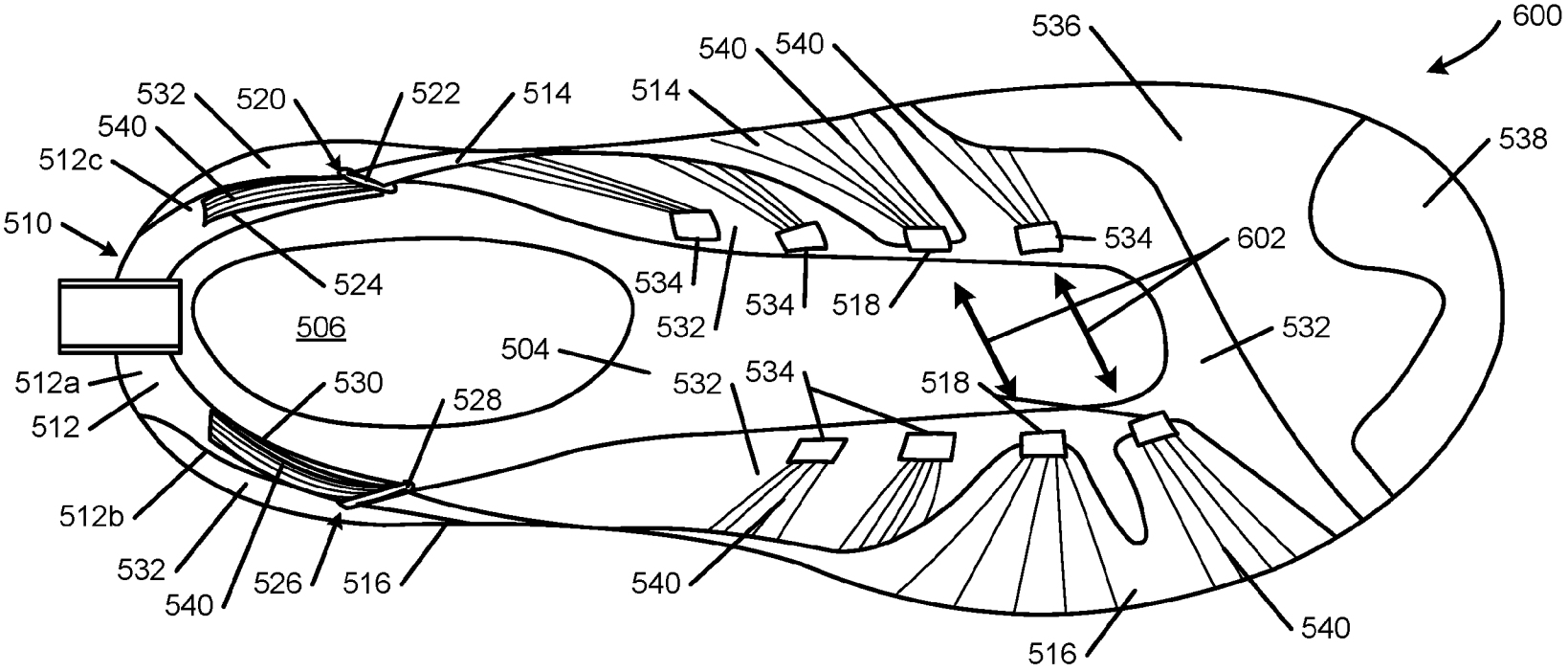
FIG. 6 illustrates a top view of another example upper and/or article of footwear including various features and aspects of this invention.

FIG. 6 illustrates an example upper 600 similar to that shown in FIGS. 5A through 5C (and labeled with many of the same reference numbers), but in this example upper 600, the lacing configuration is somewhat different. More specifically, as shown in FIG. 6, the lace engaging elements 518 and 534 are somewhat more offset and off-center so that the laces will extend generally in a lateral-front to medial-rear direction. With the laces offset in this manner, when they are pulled to tighten around the wearer's foot, the pull direction of the laces better aligns with the fibers or wires 540 and/or the strap extension directions (and especially helps align the end lace engaging components 518 of strap members 514 and 516 with the pull direction, as shown by lace pull direction arrows 602). Note how direction arrows 602 substantially align with the fiber or wires 540 in the end elements of strap members 514 and 516. This alignment provides a firm and comfortable feel to the wearer as the laces are tightened.

III. Conclusion

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An article of footwear, comprising:

an upper defining a medial side, a lateral side, a rear heel area, and an ankle opening;

a rear heel strap member engaged with or integrally formed with the rear heel area of the upper, wherein the rear heel strap member includes: (a) a rear heel element, (b) a lateral side strap element that extends from the rear heel element and along the lateral side of the ankle opening, wherein the lateral side strap element includes a free end, and (c) a medial side strap element that extends from the rear heel element and along the medial side of the ankle opening wherein the medial side strap element includes a free end;

a first strap member extending along the medial side of the upper to a medial midfoot area of the upper, wherein the first strap member includes at least one structure for engaging a lace, and wherein the first strap member further includes a free end located at a medial heel area of the upper;

a second strap member extending along the lateral side of the upper, along a lateral midfoot area of the upper, and to a lateral forefoot area of the upper, wherein the second strap member includes at least two structures for engaging the lace, and wherein the second strap member further includes a free end located at a lateral heel area of the upper;

a first tensioning ring engaged with the free of the first strap member, wherein the free end of the medial side strap element extends through the first tensioning ring to engage the medial side strap element with the first strap member;

a second tensioning ring engaged with the free end of the second strap member, wherein the free end of the lateral side strap element extends through the second tensioning ring to engage the lateral side strap element with the second strap member; and a sole structure engaged with the upper.

2. An article of footwear according to claim 1, wherein the first strap member includes only one structure for engaging the lace and the second strap member includes only two structures for engaging the lace.

3. An article of footwear according to claim 2, wherein the two structures for engaging the lace provided with the second strap member are located closer to a forward-most location of the article of footwear than the structure for engaging the lace provided with the first strap member.

4. An article of footwear according to claim 1, wherein the upper includes structures for engaging the lace that are not included as part of the first strap member or the second strap member.

5. An article of footwear according to claim 1, further comprising:

a lace engaged with the upper, engaged with the structure or structures for engaging the lace provided with the first strap member, and engaged with the structures for engaging the lace provided with the second strap member.

6. An article of footwear according to claim 5, wherein the upper includes a bootie element for receiving a wearer's foot, wherein the bootie element is exposed in an instep area across a midfoot area of the upper and lies directly beneath at least portions of the lace as the lace extends across the midfoot area of the upper.

7. An article of footwear according to claim 1, wherein the upper includes a bootie element for receiving a wearer's foot.

8. An article of footwear according to claim 7, wherein the upper further includes a shell member that at least partially covers the bootie element, and wherein the shell member partially underlies the first strap member and the second strap member.

9. An article of footwear according to claim 8, wherein the shell member includes plural structures for engaging a lace that are separate from the structures for engaging a lace provided with the first and second strap members.

10. An article of footwear according to claim 7, wherein the bootie element is exposed in an instep area across a midfoot area of the upper.

11. An article of footwear according to claim 1, wherein the first strap member includes only one structure for engaging the lace and the second strap member includes only two separate structures for engaging the lace, wherein the structure for engaging the lace of the first strap member defines a first tunnel through which a lace passes, and wherein the two structures for engaging the lace of the second strap member define a second tunnel and a third tunnel through which the lace passes.

12. An article of footwear according to claim 1, wherein each of the first strap member and the second strap member includes support fibers or wires attached to or embedded in it.

13. An article of footwear according to claim 12, wherein the upper further includes a bootie element for receiving a wearer's foot and a shell member that at least partially covers the bootie element, wherein the shell member includes plural structures for engaging a lace that are separate from the structures for engaging a lace provided with the first and second strap members, and wherein the structures for engaging a lace and the support fibers or wires attached to or embedded in the first strap member and the second strap member are arranged so that a pull direction of the lace, when the lace is tightened, substantially aligns with the support fibers or wires.

14. An article of footwear according to claim 1, wherein the upper further includes a bootie element for receiving a wearer's foot and a shell member that at least partially covers the bootie element, wherein the shell member includes plural structures for engaging a lace that are separate from the structures for engaging a lace provided with the first and second strap members, and wherein the structures for engaging a lace are arranged so that the lace will extend across an instep area of the upper in a lateral-front to medial-rear direction.

15. An article of footwear according to claim 1, wherein the sole structure includes a first cleat, wherein the first cleat includes:

a cleat base, wherein an outer perimeter of the cleat base constitutes a closed geometric shape having from three to five inwardly curved sides and three to five corner regions joining adjacent sides;

a cleat end surface, wherein an outer perimeter of the cleat end surface constitutes a closed geometric shape having from three to five inwardly curved sides and three to five corner regions joining adjacent sides, wherein the closed geometric shape of the cleat base has the same number of sides and corner regions as the closed geometric shape of the cleat end surface, and wherein the closed geometric shape of the cleat end surface encloses a smaller area than the closed geometric shape of the cleat base; and a cleat body extending between the cleat base and the cleat end surface, wherein the cleat body includes a plurality of edges, wherein each edge of the plurality of edges extends between a corner region of the cleat base and a corresponding corner region of the cleat end surface.

16. An article of footwear according to claim 15, wherein each of the plurality of edges of the cleat body is curved.

17. An article of footwear according to claim 15, wherein each of the cleat base and the cleat end surface has four sides and four corner regions, and wherein the cleat body includes four edges joining the respective four corner regions of the cleat base and the cleat end surface.

18. An article of footwear according to claim 15, wherein the cleat body has side walls extending between adjacent edges of the cleat body, and wherein the cleat body side walls are inwardly curved.

19. An article of footwear according to claim 1, wherein the sole structure includes:

a base member; and a plurality of cleats engaged with or integrally formed with the base member, wherein at least some of the cleats include a first cleat structure having:

(a) a cleat base engaged or integrally formed with the base member, wherein an outer perimeter of the cleat base constitutes a closed geometric shape having from three to five inwardly curved sides and three to five corner regions joining adjacent sides;

(b) a cleat end surface, wherein an outer perimeter of the cleat end surface constitutes a closed geometric shape having from three to five inwardly curved sides and three to five corner regions joining adjacent sides, wherein the closed geometric shape of the cleat base has the same number of sides and corner regions as the closed geometric shape of the cleat end surface, and wherein the closed geometric shape of the cleat end surface encloses a smaller area than the closed geometric shape of the cleat base; and (c) a cleat body extending between the cleat base and the cleat end surface, wherein the cleat body includes a plurality of edges, wherein each edge of the plurality of edges extends between a corner region of the cleat base and a corresponding corner region of the cleat end surface.

20. A sole structure for an article of footwear according to claim 19, wherein, in the first cleat structure, each of the plurality of edges of the cleat body is curved.

* * * * *